US009384690B2

(12) United States Patent
Ono et al.

(10) Patent No.: US 9,384,690 B2
(45) Date of Patent: Jul. 5, 2016

(54) ORGANIC EL DISPLAY APPARATUS

(71) Applicant: JOLED INC., Tokyo (JP)

(72) Inventors: Shinya Ono, Osaka (JP); Kouhei Ebisuno, Kyoto (JP)

(73) Assignee: JOLED INC., Tokyo (JP)

( * ) Notice: Subject to any disclaimer, the term of this patent is extended or adjusted under 35 U.S.C. 154(b) by 567 days.

(21) Appl. No.: 13/684,807

(22) Filed: Nov. 26, 2012

(65) Prior Publication Data

US 2013/0106676 A1 May 2, 2013

Related U.S. Application Data

(63) Continuation of application No. PCT/JP2011/004274, filed on Jul. 28, 2011.

(30) Foreign Application Priority Data

Jul. 29, 2010 (JP) ..... 2010-171143

(51) Int. Cl.
*G09G 3/30* (2006.01)
*G09G 3/32* (2016.01)

(52) U.S. Cl.
CPC ..... *G09G 3/30* (2013.01); *G09G 3/3233* (2013.01); *G09G 2330/028* (2013.01)

(58) Field of Classification Search
None
See application file for complete search history.

(56) References Cited

U.S. PATENT DOCUMENTS 6,714,178 B2 3/2004 Koyama et al.
6,756,958 B2 6/2004 Furuhashi et al.
7,148,630 B2 12/2006 Koyama et al.
7,728,325 B2 6/2010 Jung et al.
7,911,426 B2 3/2011 Eom et al.
8,125,415 B2 2/2012 Koyama et al.
2001/0043168 A1* 11/2001 Koyama et al. ..... 345/52
2002/0063703 A1 5/2002 Furuhashi et al.
2004/0257312 A1 12/2004 Koyama et al.

(Continued)

FOREIGN PATENT DOCUMENTS

CN 1355522 6/2002
JP 08-171081 7/1996

(Continued)

OTHER PUBLICATIONS

International Search Report in PCT/JP2011/004274, dated Aug. 30, 2011.

(Continued)

*Primary Examiner* — Kent Chang
*Assistant Examiner* — Benjamin Morales Fernande
(74) *Attorney, Agent, or Firm* — Greenblum & Bernstein, P.L.C.

(57) ABSTRACT

In an organic electroluminescence (EL) display apparatus, a bus line is provided on an edge of a display unit in a display panel. A feedback circuit unit is provided outside of the bus line, and an output voltage of the feedback circuit unit is applied to a connecting part on the bus line. To the feedback circuit unit, a reference voltage from a reference voltage generating unit is applied, a power supply voltage from a power supply unit is supplied, and a monitoring voltage from the connecting part on the bus line is fed back. The feedback circuit unit includes a switching control circuit and a transistor, and controls, using a feedback, the output voltage by supplying or blocking the power supply voltage to an output terminal, so that a voltage at the connecting point is equal to a target voltage determined by the reference voltage.

19 Claims, 21 Drawing Sheets

(56) References Cited

U.S. PATENT DOCUMENTS

| | | | |
|---|---|---|---|
| 2006/0077144 | A1 | 4/2006 | Eom et al. |
| 2007/0080917 | A1 | 4/2007 | Koyama et al. |
| 2007/0152922 | A1 | 7/2007 | Jung et al. |
| 2012/0153293 | A1 | 6/2012 | Koyama et al. |

FOREIGN PATENT DOCUMENTS

| | | |
|---|---|---|
| JP | 09-281928 | 10/1997 |
| JP | 2002-032037 | 1/2002 |
| JP | 2005-236848 | 9/2005 |
| JP | 4424549 | 3/2010 |
| JP | 4426561 | 3/2010 |

OTHER PUBLICATIONS

China Office Action from The Patent Office of the People's Republic of China in Chinese Patent Application No. 201180016636.X, dated Aug. 4, 2014, together with a partial English language translation.

* cited by examiner

ORGANIC EL DISPLAY APPARATUS

CROSS REFERENCE TO RELATED APPLICATIONS

This is a continuation application of PCT Patent Application No. PCT/JP2011/004274 filed on Jul. 28, 2011, designating the United States of America, which is based on and claims priority of Japanese Patent Application No. 2010-171143 filed on Jul. 29, 2010. The entire disclosures of the above-identified applications, including the specifications, drawings and claims are incorporated herein by reference in their entirety.

TECHNICAL FIELD

One or more exemplary embodiments disclosed herein relate generally to an organic electroluminescence (EL) display apparatus, and particularly to a technique for improving display quality in the organic EL display apparatus.

BACKGROUND ART

The organic EL display apparatus is known as a thin and light light-emitting display apparatus capable of achieving light-emission with high-speed response and a wide viewing angle, using electroluminescence of an organic compound. The organic EL display apparatus includes a display unit in which multiple pixel units each of which is individually controlled for light-emission are arranged two-dimensionally, and a control unit for controlling the light-emission from the pixel units. A pixel current for the light-emission from each of the pixel units in the display unit is supplied through a power supply bus line (hereafter simply referred to as a bus line) provided in the outer periphery of the display unit.

If the voltage in the bus line is not even, uneven voltage is supplied from the bus line to the light-emitting pixel units. This causes a problem of uneven luminance in a display screen. In response to this problem, there have been various configurations for reducing the unevenness in the voltage at the bus line.

For example, the light-emitting display apparatus disclosed in the patent literature 1 is configured to have equal line resistance from the power supply to each power supply line, by providing two power supply lines (bus lines) above and below the display unit, and by connecting each of the power supply lines with the power supply, using a line of a suitable length. This configuration makes a voltage drop in each power supply line even, thereby making luminance of the light-emission even.

In addition, in the display apparatus disclosed in the patent literature 2, two sub-voltage pads (bus lines) are provided opposite to each other on sides of the display unit, and the two sub-electrode pads are connected by a connecting part having a low resistance. In such a display apparatus, the voltages at the two sub-voltage pads are even, setting the luminance in the entire screen even.

CITATION LIST

Patent Literature

[Patent Literature 1] Japanese Patent No. 4424549

[Patent Literature 2] Japanese Patent No. 4426561

SUMMARY

Technical Problem

However, with the conventional technique, when the amount of the pixel current is uneven in the display screen depending on a display pattern, the unevenness in voltage generated in the bus line due to the resistance in the line connecting the bus line and the power supply and the resistance in the bus line itself.

A particularly significant unevenness in the voltage in the bus line is observed when a significantly low resistance (a large sized) bus line for the pixel current required cannot be provided due to the increase in size of the organic EL display apparatus and the decrease in the size of a frame.

One non-limiting and exemplary embodiment has been conceived in view of the problem, and provides an organic EL display apparatus in which the pixel current for the light-emission from each pixel unit in the display unit is supplied through the bus line which is a power supply line provided in the outer periphery of the display unit, and having a configuration suitable for reducing the degradation in the quality of the display caused by the unevenness in the voltage at the bus line.

Solution to Problem

In one general aspect, the techniques disclosed here feature an aspect of a display panel apparatus including: a display unit in which a plurality of pixel units each including an organic EL element are provided on a substrate; a power supply bus line which is provided in an outer periphery of the display unit and supplies, to each of the pixel units in the display unit, a driving voltage for driving the pixel unit; a feedback circuit unit which generates an output voltage and supply the output voltage to the power supply bus line; a power supply unit which supplies, to the feedback circuit unit, a power supply voltage including a high power supply voltage for driving the feedback circuit unit and a low power supply voltage which is lower than the high power supply voltage; and a reference voltage generating unit which supplies, to the feedback circuit unit, a reference voltage for determining a target voltage to be a voltage in the power supply bus line, in which the feedback circuit unit generates the output voltage based on the power supply voltage supplied from the power supply unit, the feedback circuit unit includes: a first power supply terminal to which the high power supply voltage of the power supply voltage is applied; a second power supply terminal to which the low power supply voltage of the power supply voltage is applied; a first input terminal to which the reference voltage is applied; an output terminal connected to a connecting part which is a part of the power supply bus line; a second input terminal to which a voltage at the connecting part in the power supply bus line is applied; a switching control circuit connected to the first power supply terminal, the second power supply terminal, the first input terminal, and the second input terminal; and a transistor having one terminal connected to one of the first power supply terminal and the second power supply terminal, and the other terminal connected to the output terminal, a voltage obtained by adding a difference to the voltage at the connecting part in the power supply bus line is provided to the output terminal by supplying or blocking the power supply voltage to be applied to the one of the first and second power supply terminals as the power supply voltage by turning the transistor on or off, so that the voltage at the connecting part in the power supply bus line is equal to the target voltage defined by the reference voltage, and the difference added corresponds to a voltage drop calculated as a product of (i) a resistance between the output terminal of the feedback circuit unit and the connecting part in the power supply bus line and (ii) a current flowing between the output terminal of the feedback circuit unit and the connecting part in the power supply bus line.

Additional benefits and advantages of the disclosed embodiments will be apparent from the Specification and Drawings. The benefits and/or advantages may be individually obtained by the various embodiments and features of the Specification and Drawings, which need not all be provided in order to obtain one or more of such benefits and/or advantages.

Advantageous Effects

According to the present disclosure, the bus line is provided along the edge of the display unit, and the feedback circuit units are provided outside of the display unit. The feedback circuit units generate the output voltage, applies the output voltage generated to the connecting part which is a part of the bus line, and monitors the voltage at the connecting part. The reference voltage is applied to the feedback circuit unit, and the feedback circuit unit regulates the output voltage such that the monitored voltage will be equal to the target voltage determined by the reference voltage applied. This makes the voltage at the connecting part of the bus line even regardless of the display pattern, improving the quality of display.

With this configuration, it is not necessary to reduce the resistance in the bus line, evening out the voltage at the bus line, independent of a display pattern. Therefore, in addition to the improved quality of display, it is advantageous to reduce an area for a frame, since it is not necessary to provide the bus line in a large area.

BRIEF DESCRIPTION OF DRAWINGS

These and other advantages and features will become apparent from the following description thereof taken in conjunction with the accompanying Drawings, by way of non-limiting examples of embodiments of the present disclosure.

DETAILED DESCRIPTION (Knowledge Underlying the Present Disclosure)

The inventors found out the following problems with regard to the light-emitting apparatus described in the Background.

Figure 19:
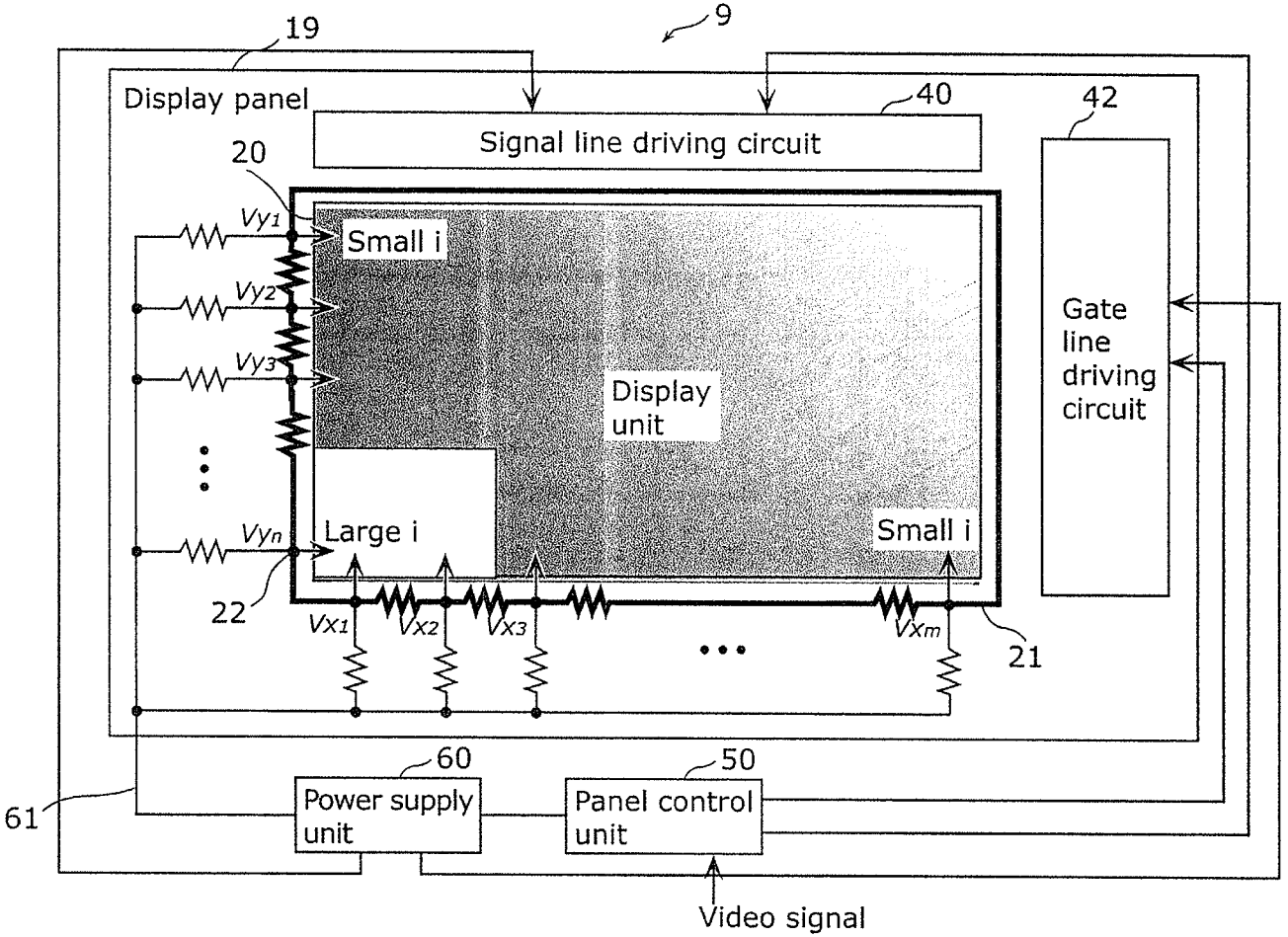
FIG. 19 illustrates an example of display by a conventional organic EL display apparatus.

FIG. 19 illustrates the conventional problem using an example of a general organic EL display apparatus 9.

The organic EL display apparatus 9 includes a display panel 19, a panel control unit 50, a power supply unit 60, and a line 61. The display panel 19 includes a display unit 20, a bus line 21, a signal line driving circuit 40, and a gate line driving circuit 42.

In the display unit 20, multiple pixels that are not illustrated each individually controlled for light-emission are arranged two-dimensionally. The bus line 21 is provided in a periphery of the display unit 20, and the bus line 21 is connected to the power supply unit 60 at connecting parts 22 via the line 61. The pixel current is supplied from the line extending from the connecting parts 22 of the bus line 21 toward the inside of the display unit 20.

The panel control unit 50 receives an image signal representing an image to be displayed on the organic EL display apparatus 9 from outside of the organic EL display apparatus 9, and controls the signal line driving circuit 40 and the gate line driving circuit 42, according to the image signal.

Each of the pixel units in the display unit 20 emits light in individual luminance, using the pixel current supplied from a connecting part 22 in the bus line 21, according to a control signal from the signal line driving circuit 40 and the gate line driving circuit 42. With this, the image represented by the image signal is displayed on the display unit 20.

In FIG. 19, resistance in the bus line 21 and the line 61 is illustrated. The resistance includes resistance in line formed on the display panel 19, and resistance in line of a flexible substrate attached to the display panel 19.

For example, as illustrated in FIG. 19, a display of an image in which a region on the lower left side of the drawing is in high luminance (for example, white), and the rest of the screen is in even low luminance (for example, uniform gray) is considered. Here, in the pixel units in the high luminance region, a pixel current larger than the pixel current in the other pixel units flows, causing unevenness in the pixel current in the display screen.

The uneven pixel current forms a complex voltage distribution on a circuit network composed by the resistance of the bus line 21 and the line 61. As a result, the voltages $V_{x1}$, $V_{y1}$, . . . in the connecting parts 22 are uneven. More specifically, when the bus line 21 is for positive power supply, the voltage at the connecting part 22 near the high luminance region is lower than the voltage at other connecting parts 22.

Since the voltages at the connecting parts 22 in the bus line 21 are uneven, the luminance in the pixel units (more precisely, the pixel current determined by the operating point in the driving transistor included in the pixel unit) is uneven, degrading the quality of the displayed image. More specifically, as illustrated in FIG. 19, there is unevenness in luminance in the region that should be displayed in uniform gray is dark near the white region and becomes brighter farther away from the white region.

In order to solve the problem described above, one aspect of the organic EL display apparatus according to the present disclosure includes a display unit in which a plurality of pixel units each including an organic EL element are provided on a substrate; a power supply bus line which is provided in an outer periphery of the display unit and supplies, to each of the pixel units in the display unit, a driving voltage for driving the pixel unit; a feedback circuit unit which generates an output voltage and supply the output voltage to the power supply bus line; a power supply unit which supplies, to the feedback circuit unit, a power supply voltage including a high power supply voltage for driving the feedback circuit unit and a low power supply voltage which is lower than the high power supply voltage; and a reference voltage generating unit which supplies, to the feedback circuit unit, a reference voltage for determining a target voltage to be a voltage in the power supply bus line, in which the feedback circuit unit generates the output voltage based on the power supply voltage supplied from the power supply unit, the feedback circuit unit includes: a first power supply terminal to which the high power supply voltage of the power supply voltage is applied; a second power supply terminal to which the low power supply voltage of the power supply voltage is applied; a first input terminal to which the reference voltage is applied; an output terminal connected to a connecting part which is a part of the power supply bus line; a second input terminal to which a voltage at the connecting part in the power supply bus line is applied; a switching control circuit connected to the first power supply terminal, the second power supply terminal, the first input terminal, and the second input terminal; and a transistor having one terminal connected to one of the first power supply terminal and the second power supply terminal, and the other terminal connected to the output terminal, a voltage obtained by adding a difference to the voltage at the connecting part in the power supply bus line is provided to the output terminal by supplying or blocking the power supply voltage to be applied to the one of the first and second power supply terminals as the power supply voltage by turning the transistor on or off, so that the voltage at the connecting part in the power supply bus line is equal to the target voltage defined by the reference voltage, and the difference added corresponds to a voltage drop calculated as a product of (i) a resistance between the output terminal of the feedback circuit unit and the connecting part in the power supply bus line and (ii) a current flowing between the output terminal of the feedback circuit unit and the connecting part in the power supply bus line.

According to this aspect, the voltage obtained by adding the difference to the voltage at the connecting part in the power supply bus line such that the voltage at the connecting part in the power supply bus line is equal to the target voltage determined by the reference voltage is provided to the output terminal as the output voltage.

Here, the difference added corresponds to a voltage drop calculated as a product of (i) a resistance between the output terminal of the feedback circuit unit and the connecting part in the power supply bus line and (ii) a current flowing between the output terminal of the feedback circuit unit and the connecting part in the power supply bus line.

With this, the voltage at the connecting part in the power supply bus line is corrected to the target voltage determined by the reference voltage such that the voltage drop caused by the resistance between the output terminal of the feedback circuit unit and the connecting part in the power supply bus line is cancelled. Accordingly, even if the voltage drop changes, it is possible to prevent the change in the voltage at the connecting part. Accordingly, it is possible to suppress the change in the driving voltage supplied to the pixel unit, improving the display quality of the image.

Furthermore, the feedback circuit unit includes the switching control circuit and the transistor, and the switching control circuit controls the transistor for turning on/off. Therefore, the feedback control circuit unit supplies or blocks the power supply voltage applied to the one of the power supply terminals, according to the turn-on state or the turn-off state of the transistor. With this, the voltage obtained by adding the difference to the voltage at the connecting part in the power supply bus line is provided to the output terminal as the output voltage, such that the voltage at the connecting part in the power supply bus line is equal to the target voltage determined by the reference voltage.

Furthermore, in the feedback circuit unit, the transistor having one terminal connected to the one of the power supply terminals and the other one of the terminals connected to the output terminal is used. With this, when the voltage at the connecting part in the power supply bus line is greater than the target voltage, the transistor is turned off, since it is not necessary to provide the voltage from the power supply voltage to the output terminal. When the voltage at the connecting part in the power supply bus line is smaller than the target voltage, the transistor is turned on with a significantly low voltage, since it is necessary to supply the voltage from the power supply voltage to the output terminal.

Furthermore, the organic EL display apparatus may include a capacitor including a first electrode and a second electrode, the first electrode being connected to the power supply bus line, and the second electrode being connected to a fixed potential.

According to this aspect, the capacitor can smooth the voltage in the bus line.

Furthermore, the switching control circuit may compare the voltage at the connecting part and the reference voltage, by using a comparator, output, when it is determined that the voltage at the connecting part is smaller than the target voltage defined by the reference voltage, a gate signal in a level Von for turning the transistor on, and output, when it is determined that the voltage at the connecting part is greater than the target voltage, a gate signal in a level Voff for turning the transistor off.

According to this aspect, as a result of the comparison using the comparator, it is possible to set the voltage at the connecting part in the power supply bus line to a voltage equal to the target voltage determined by the reference voltage.

Furthermore, when the feedback circuit unit determines that the voltage at the connecting part in the power supply bus line is greater than the target voltage, the feedback circuit unit may stop supplying the output voltage so as to reduce the driving voltage.

According to this aspect, when the voltage drop decreases, the feedback circuit unit stops supplying the output voltage so as to reduce the driving voltage.

Furthermore, when the feedback circuit unit determines that the voltage at the connecting part in the power supply bus line is smaller than the target voltage, the feedback circuit unit may resume the supply of the output voltage so as to increase the driving voltage.

According to this aspect, when the voltage drop increases, it is possible to set the voltage to the target voltage by resuming the supply of the power supply voltage so as to increase the driving voltage.

Furthermore, when the feedback circuit unit determines that the voltage at the connecting part in the power supply bus line is smaller than the target voltage, the feedback circuit unit may stop supplying the output voltage so as to increase the driving voltage.

According to this aspect, when the voltage drop decreases, the feedback circuit unit stops supplying the output voltage so as to increase the driving voltage.

Furthermore, when the feedback circuit unit determines that the voltage at the connecting part in the power supply bus line is greater than the target voltage, the feedback circuit unit may resume the supply of the output voltage so as to reduce the driving voltage.

According to this aspect, when the voltage drop increases, it is possible to set the voltage to the target voltage by resuming the supply of the power supply voltage so as to reduce the driving voltage.

Furthermore, the feedback circuit unit may include a plurality of feedback circuit units, in which the plurality of the feedback circuit units may be connected to the power supply bus line at a plurality of connecting parts.

According to this aspect, the voltage drop caused by the resistance between (i) the connecting part of the output terminal of the feedback circuit unit and the power supply bus line and (ii) the output terminal of the feedback circuit unit is corrected at the connecting points. Accordingly, even if there is a voltage drop between (i) the connecting part of the output terminal of the feedback circuit unit and the power supply bus line and (ii) the output terminal of the feedback circuit unit, it is possible to set the potential at the connecting points even. Accordingly, it is possible to suppress the change in the driving voltage supplied to the pixel units, improving the display quality of the image.

Furthermore, the connecting parts may be provided at a constant interval between each other in the power source bus line.

Even when each of the potentials at the feedback circuit units and the potentials at the connecting part in the power supply bus line are controlled to be equal to a potential equal to the reference voltage, there is a voltage drop between the connecting parts in the power supply bus line. Accordingly, if the interval between the connecting parts is not equidistant, this causes variation in the voltage drop between the connecting parts, causing a variation in the voltage supplied to the display unit. More specifically, the shorter the distance between the connecting parts is, the smaller the amount of change due to the voltage drop becomes. The longer the distance between the connecting parts is, the larger the amount of change due to the voltage drop becomes.

According to this aspect, each of the feedback circuit units is connected to the power supply bus line with the constant interval. With this, the interval between the feedback circuit units and the connecting part of the power supply bus line is set to a constant distance. Accordingly, it is possible to set the voltage drop amount generated between connecting parts in the power supply bus line to be even. Therefore, it is possible to suppress the unevenness in the display further.

Furthermore, each of the feedback circuit units may set the target voltage to a voltage obtained by multiplying the reference voltage provided to the first input terminal by a gain greater than 1.

According to this aspect, the target voltage is set by amplifying the reference voltage input to the first input terminal (that is, by multiplying the gain greater than 1). With this, the target voltage is set by amplifying the reference voltage. Accordingly, it is possible to reduce the reference voltage supplied from the reference voltage generating unit. Accordingly, it is possible to provide the driving voltage corresponding to the desired voltage while reducing the reference voltage supplied from the reference voltage generating unit, thereby reducing the power consumption.

Furthermore, each of the feedback circuit units may set the target voltage to the reference voltage provided to the first input terminal, and increases and reduces the voltage at the connecting part in the power supply bus line, such that the voltage at the connecting part is equal to the reference voltage.

According to this aspect, the voltage at the connecting part in the power supply bus line is increased or reduced such that the voltage at the connecting part of the power supply bus line is equal to the reference voltage.

Furthermore, each of the feedback circuit units may be provided in a periphery on at least one of a right side and a left side of the display unit.

According to this aspect, the feedback circuit units are provided in at least one of on the right side and the left side of the display unit.

Furthermore, each of the feedback circuit units may be provided in a periphery on at least one side above and below the display unit.

According to this aspect, the feedback circuit units are provided in the periphery on at least one side above and below the display unit.

Furthermore, The organic EL display apparatus may further include: a plurality of first power supply lines electrically connected to a first electrode of the organic EL element in each of the pixel units; and a plurality of second power supply lines electrically connected to a second electrode of the organic EL element in each of the pixel units, in which one of (i) the first power supply lines and (ii) the second power supply lines may be connected to the power supply bus line.

Furthermore, each of the feedback circuit units may be connected to the power supply bus line on a shorter side of the power supply bus line, and the one of (i) the first power supply lines and (ii) the second power supply lines may diverge from the connecting parts of the output terminals of the feedback circuit units and the power supply bus line, and may be provided in a horizontal direction of the display unit.

Furthermore, each of the feedback circuit units may be connected to the power supply bus line on a longer side of the power supply bus line, and the one of (i) the first power supply lines and (ii) the second power supply lines may diverge from the connecting parts of the output terminals of the feedback circuit units and the power supply bus line, and may be provided in a vertical direction of the display unit.

Furthermore, each of the feedback circuit units may be connected to the power supply bus line on a shorter side and a longer side of the power supply bus line, and the one of (i) the first power supply lines and (ii) the second power supply lines may diverge from the connecting parts of the output terminals of the feedback circuit units and the power supply bus line, and may be provided in a horizontal direction and a vertical direction of the display unit.

Furthermore, the power supply bus line may be provided as a loop in the outer periphery of the display unit.

These aspects enable various arrangements of the feedback circuit units at the periphery of the display unit.

Furthermore, the connecting part may include: a power supply point connected to the output terminal of the feedback circuit unit through a power supply line; and a monitoring point connected to the output terminal of the feedback circuit unit through a monitoring line, and a distance between the power supply point and the monitoring point is smaller than or equal to a width of the power supply bus line.

According to this aspect, the power supply point and the monitoring point is provided close to each other within the width of the power supply bus line. Accordingly, it is possible to limit the error on the driving voltage from the target voltage, due to the voltage drop from the power supply point in the power supply bus line to the monitoring point, smaller than or equal to an upper limit value according to the width of the power supply bus line.

An aspect of the organic EL display apparatus according to the present disclosure includes: a display unit in which a plurality of pixel units each including an organic EL element are provided on a substrate; a power supply bus line which is provided in an outer periphery of the display unit and supplies, to each of the pixel units in the display unit, a driving voltage for driving the pixel unit; a feedback circuit unit configured to generate an output voltage and supplies the output voltage to the power supply bus line; a power supply unit configured to supply, to the feedback circuit unit, a power supply voltage for driving the feedback circuit unit; and a reference voltage generating unit configured to supply a first reference voltage and a second reference voltage to the feedback circuit unit, the first reference voltage being a voltage having a potential lower than a driving voltage to be provided from the feedback circuit unit and for converting an absolute value of the driving voltage to be provided from the feedback circuit unit to a voltage having a potential smaller than the absolute value, and the second reference voltage being a voltage having a potential lower than the driving voltage to be provided from the feedback circuit unit and being a reference for regulating the converted voltage, in which the feedback circuit unit generates the output voltage based on the power supply voltage supplied from the power supply unit, the feedback circuit unit includes: a power supply terminal to which the power supply voltage is applied; an output terminal connected to a connecting part which is a part of the power supply bus line; a first input terminal to which the first reference voltage is applied; a second input terminal to which a voltage at the connecting part in the power supply bus line is applied; a third terminal to which the second reference voltage is applied; and a first resistor and a second resistor which are provided in series between the first input terminal and the second input terminal, and divide voltage applied between the first input terminal and the second input terminal, a voltage obtained by adding a difference to the voltage at the connecting part in the power supply bus line is provided to the output terminal, so that the voltage divided by the first resistor and the second resistor is equal to the second reference voltage, and the difference added corresponds to a voltage drop calculated as a product of (i) a resistance between the output terminal of the feedback circuit unit and the connecting part in the power supply bus line and (ii) a current flowing between the output terminal of the feedback circuit unit and the connecting part in the power supply bus line.

According to this aspect, the first reference voltage and the second reference voltage which are supplied from the reference voltage generating unit to the feedback circuit unit is set to a voltage with a potential lower than the driving voltage provided from the feedback circuit unit, thereby regulating the driving voltage provided from the feedback circuit unit. Accordingly, the first reference voltage and the second reference voltage are voltages with low potentials. Accordingly, the first reference voltage and the second reference voltage are supplied as signals having small amplitude. As a result, the load on the reference voltage generating unit which supplies the first reference voltage and the second reference voltage, thereby simplifying and miniaturizing the reference voltage generating unit.

(Embodiment)

The following shall describe an organic EL display apparatus according to a non-limiting embodiment in detail with reference to the drawings.

Each of the exemplary embodiments described below shows a general or specific example. The numerical values, shapes, materials, structural elements, the arrangement and connection of the structural elements, steps, the processing order of the steps etc. shown in the following exemplary embodiments are mere examples, and therefore do not limit the scope of appended Claims and their equivalents. Therefore, among the structural elements in the following exemplary embodiments, structural elements not recited in any one of the independent claims are described as arbitrary structural elements.

Figure 1:
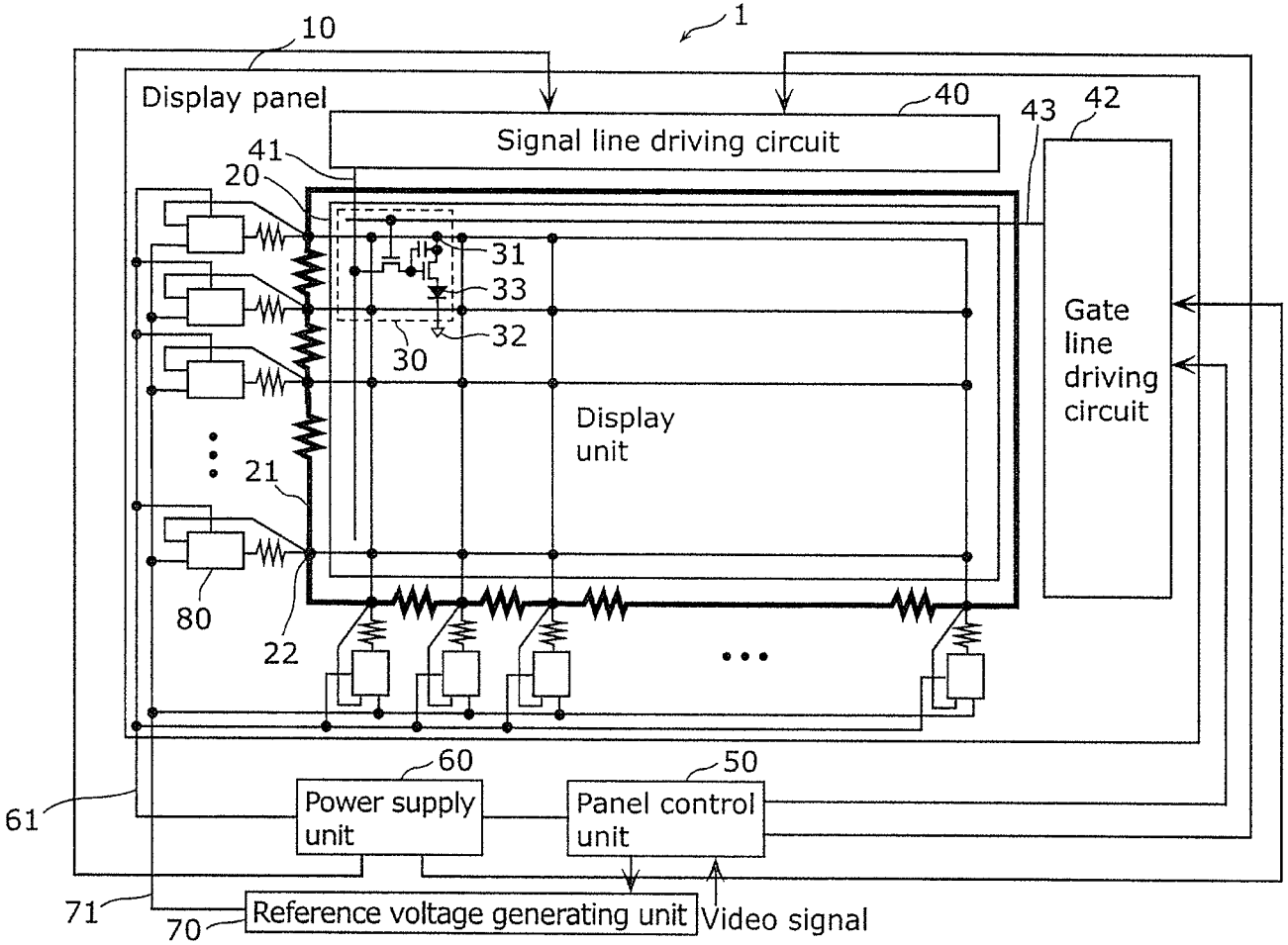
FIG. 1 is a block diagram illustrating an example of a functional configuration of an organic EL display apparatus according to an embodiment.

FIG. 1 is a block diagram illustrating an example of a functional configuration of an organic EL display apparatus 1 according to the embodiment. The organic EL display apparatus 1 includes a display panel 10 having a feedback circuit unit 80, instead of the display panel 19 in the organic EL display apparatus 9 in FIG. 19 of the conventional art, and further includes a reference voltage generating unit 70 and a reference voltage line 71. In addition, FIG. 1 illustrates an internal configuration of the display unit 20 in further detail.

In the display unit 20, pixels 30 each including an organic EL element 33 are arranged two-dimensionally. First power supply lines 31 diverge from corresponding connecting parts 22 in the bus line 21, and are extended in the display unit 20. Furthermore, although detailed illustration is omitted, second power supply lines 32 are provided in the display unit 20.

A first electrode (anode) of the organic EL element 33 is electrically connected to the first power supply line 31, and a second electrode (cathode) of the organic EL element 33 is electrically connected to the second power supply line 32.

The signal line driving circuit 40 supplies a luminance signal to the pixel unit 30 through a signal line 41. A gate line driving circuit 42 supplies a scanning signal to the pixel unit 30 through a gate line 43.

The pixel unit 30 obtains a luminance signal from the signal line 41, according to an application of the scanning signal from the gate line 43, and the organic EL element 33 emits light in luminance represented by the obtained luminance signal. The organic EL element 33 emits light according to a current supplied from the first power supply line 31 and the second power supply line 32.

A power supply unit 60 supplies a power supply voltage for driving each feedback circuit unit 80 to the feedback circuit unit 80 through the line 61. The line 61 includes two lines, one for supplying a high potential of the power supply voltage and the other for supplying a low potential of the power supply voltage, for example.

The reference voltage generating unit 70 generates a reference voltage for determining a target voltage applied to a voltage in the bus line 21, and supplies the generated reference voltage to each feedback circuit unit 80 through the reference voltage line 71.

The feedback circuit unit 80 is a voltage regulator using feedback control, and generates an output voltage from the power supply voltage supplied through the line 61. The feedback circuit unit 80 performs the feedback control on the output voltage to be generated such that a voltage at a connecting part 22 in the bus line 21 and the target voltage determined by the reference voltage applied by the reference voltage generating unit 70 are equal. The output voltage generated is applied to the connecting part 22 which is a part of the bus line 21 through line resistance.

Note that, the arrangement of the feedback circuit unit 80, the connecting part 22, and the first power supply line 31 is not limited to the example in FIG. 1.

For example, the feedback circuit units 80 are provided on at least one lateral side of a periphery of the display unit 20. Other than the arrangement in which the feedback circuit units 80 are provided only on the left side of the display unit 20, as illustrated in FIG. 1, the feedback circuit units 80 may be provided only on the right side of the display unit 20. Alternatively, the feedback circuit units 80 may be provided on both of the lateral sides of the periphery. Alternatively, the feedback circuit units 80 are provided at least on one vertical side of the display unit 20. Other than the arrangement in which the feedback circuit units 80 are provided only on the lower periphery of the display unit 20, as illustrated in FIG. 1, the feedback circuit units 80 may be provided only on the upper periphery of the display unit 20. Alternatively, the feedback circuit units 80 may be provided on the periphery both above and below the display unit 20.

In addition to the arrangement illustrated in FIG. 1, that is, the feedback circuit units 80 being connected to the bus line 21 on a shorter side and a longer side of the display unit 20, and the first power supply lines 31 provided vertical and horizontal to the display unit 20, the feedback circuit units 80 may be connected to the bus line 21 only on the shorter side of the display unit 20, and the first power supply lines 31 may be provided only horizontally to the display unit 20. Alternatively, the feedback circuit units 80 may be connected to the bus line 21 only on the longer side of the display unit 20, and the first power supply lines 31 may be provided only vertical to the display unit 20.

The description continues on the details of the feedback circuit unit 80.

Figure 2:
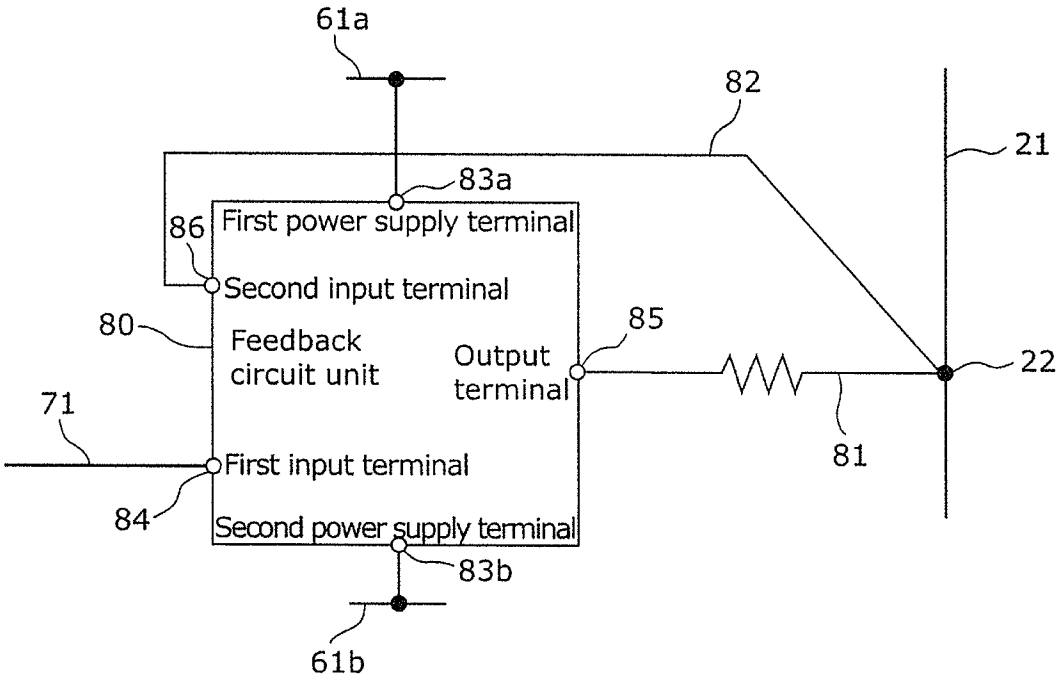
FIG. 2 is a block diagram illustrating an example of major components of an organic EL display apparatus according to the embodiment.

FIG. 2 is a block diagram illustrating an example of the major components of the organic EL display device 1 including the connecting part 22 between the feedback circuit unit 80 and the bus line 21.

The feedback circuit unit 80 includes a first power supply terminal 83*a*, a second power supply terminal 83*b*, a first input terminal 84, a second input terminal 86, and an output terminal 85.

The high potential and the low potential in the power supply voltage are applied to the first power supply terminal 83*a* and the second power supply terminal 83*b*, through the lines 61*a* and 61*b* composing the line 61, respectively. The reference voltage is applied to the first input terminal 84 through the reference voltage line 71.

The output terminal 85 is connected to the connecting part 22 through the power supply line 81, and the second input terminal 86 is connected to the connecting part 22 through the monitoring line 82.

Figure 3:
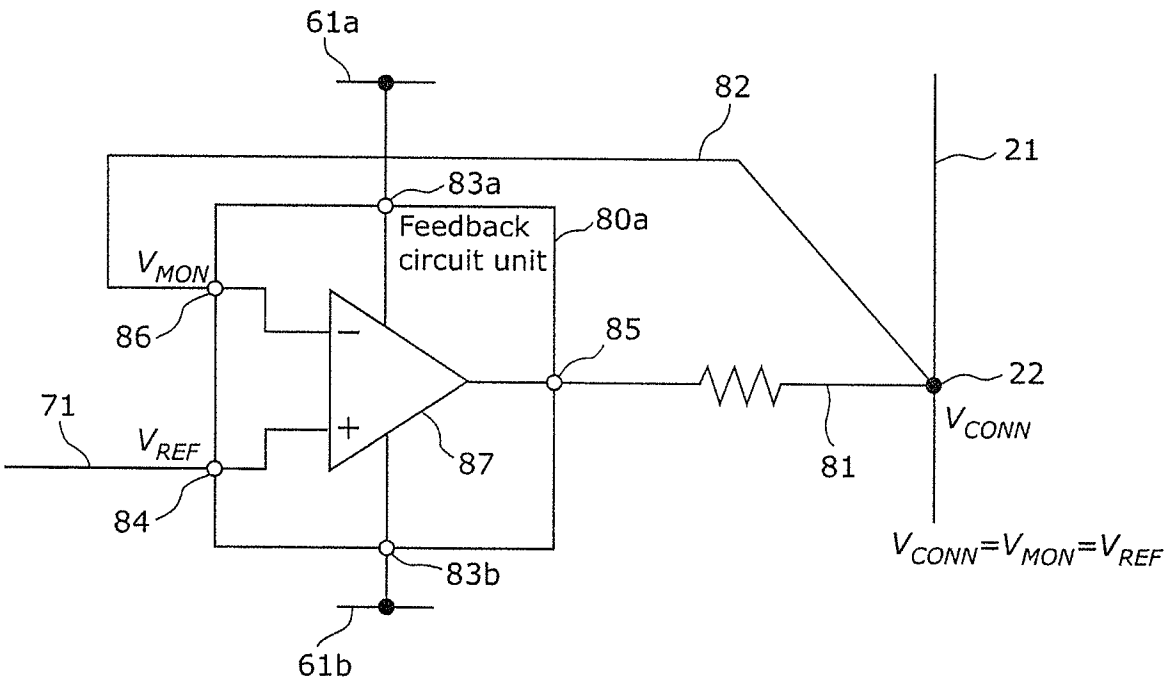
FIG. 3 is a circuit diagram illustrating an example of a feedback circuit unit according to the embodiment.

FIG. 3 is a circuit diagram of a feedback circuit unit 80*a* which is a specific example of the feedback circuit unit 80.

The feedback circuit unit 80*a* includes an error amplifier 87. The error amplifier 87 operates by the power supply voltage applied to the first power supply terminal 83*a* and the second power supply terminal 83*b*. A voltage $V_{CONN}$ at the connecting part 22 is applied to the negative input of the error amplifier 87 as a monitoring voltage $V_{MON}$. A reference voltage $V_{REF}$ is applied to the positive input of the error amplifier 87.

The error amplifier 87 regulates an output voltage at the output terminal 85 by comparing the monitoring voltage $V_{MON}$ and the reference voltage $V_{REF}$. The monitoring voltage $V_{MON}$ is regulated to a voltage calculated by adding a voltage drop calculated as a product of the resistance in the power supply line 81 and the current flowing in the output terminal 85 to the monitoring voltage $V_{MON}$.

With this, the output voltage from the feedback circuit unit 80*a* increases and decreases so as to cancel the voltage drop in the resistance in the power supply line 81. Accordingly, the voltage $V_{CONN}$ in the connecting part 22 is maintained to a value equal to the reference voltage $V_{REF}$. As a result, the voltage at the connecting part 22 in the bus line 21 is evened out to the target voltage, regardless of the display pattern.

Figure 4:
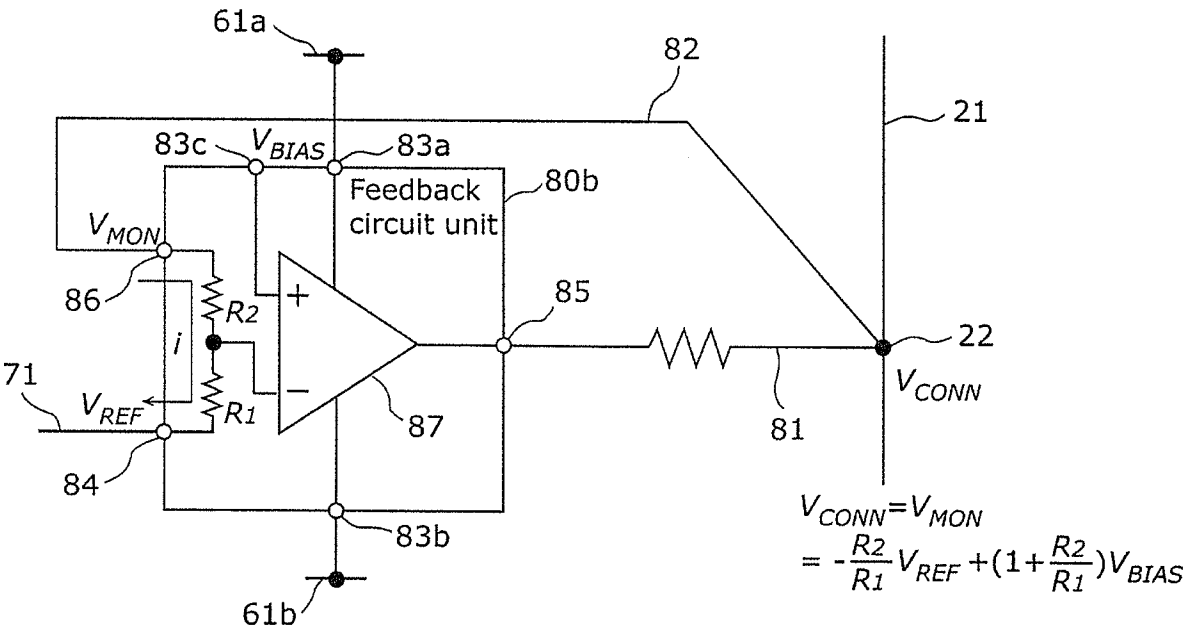
FIG. 4 is a circuit diagram illustrating an example of a feedback circuit unit according to the embodiment.

FIG. 4 is a circuit diagram of a feedback circuit unit 80*b* which is another specific example of the feedback circuit unit 80.

The feedback circuit unit 80*b* includes, in addition to the components in the feedback circuit unit 80*a*, a third power supply terminal 83*c* and gain resistors R1 and R2. In the feedback circuit unit 80*b*, the reference voltage $V_{REF}$ as the first reference voltage is applied to the first input terminal 84, and the bias voltage $V_{BIAS}$ is applied as the second reference voltage to the third power supply terminal 83*c*.

The gain resistors R1 and R2 divide the voltage applied between the first input terminal 84 and the second input terminal 86, that is, a differential voltage of the monitoring voltage $V_{MON}$ and the reference voltage $V_{REF}$. The divided voltage is applied to the negative input of the error amplifier 87.

The bias voltage $V_{BIAS}$ is generated by the reference voltage generating unit 70, for example, and may be supplied through a line not illustrated. Alternatively, 0 V, which is a ground voltage may be used as a bias voltage $V_{BIAS}$. The bias voltage $V_{BIAS}$ is applied to the positive input of the error amplifier 87.

Here, the reference voltage $V_{REF}$ as the first reference voltage is a voltage that is a potential lower than a potential of the output voltage from the feedback circuit unit 80*b*, and is a reference voltage for converting an absolute value of the output voltage provided from the feedback circuit unit 80*b* into a voltage with a potential smaller than the absolute value.

The bias voltage $V_{BIAS}$ as the second reference voltage is a voltage with a potential lower than the output voltage from the feedback circuit unit 80*b*, and is the reference voltage for regulating the output voltage.

With the feedback circuit unit 80*b*, when resistance values of the gain resistors R1 and R2 are $R_1$ and $R_2$, respectively, the voltage $V_{CONN}$ at the connecting part 22 is maintained at the target voltage determined by the reference voltage $V_{REF}$ and the bias voltage $V_{BIAS}$; that is, $-(R_2/R_1)V_{REF}+(1+R_2/R_1)V_{BIAS}$.

Stated differently, by selecting the resistance values of the gain resistors R1 and R2 to be $R_2>R_1$, a voltage obtained by multiplying the reference voltage $V_{REF}$ by a gain greater than 1 is used as a target voltage for the voltage $V_{CONN}$ at the connecting part 22. With this, it is possible to define a desired target voltage using a low-voltage reference voltage $V_{REF}$. Accordingly, it is possible to achieve low-voltage circuit configuration of the reference voltage generating unit 70, allowing a reduction in circuit area and power consumption in the reference voltage generating unit 70.

Figure 5:
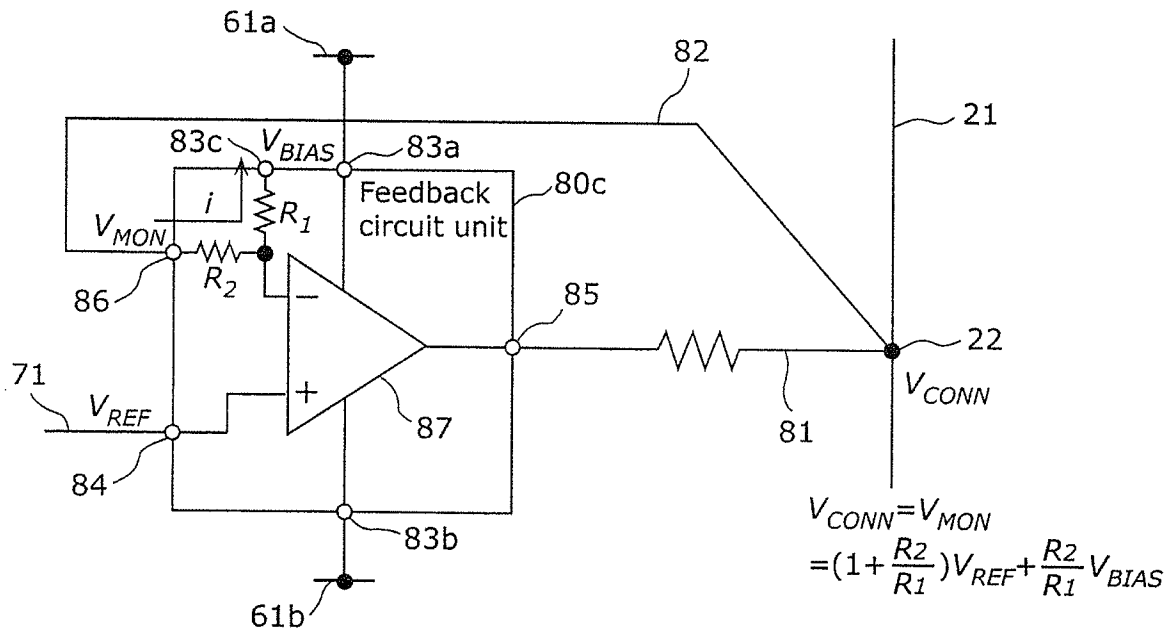
FIG. 5 is a circuit diagram illustrating an example of a feedback circuit unit according to the embodiment.

FIG. 5 is a circuit diagram of a feedback circuit unit 80*c* which is another specific example of the feedback circuit unit 80.

The feedback circuit unit 80*c* includes, in addition to the components in the feedback circuit unit 80*a*, a third power supply terminal 83*c* to which the bias voltage $V_{BIAS}$ is applied, and the gain resistors R1 and R2. The bias voltage $V_{BIAS}$ may be supplied from the reference voltage generating unit 70, for example, and the ground voltage 0 V may be used.

By the feedback circuit unit 80*c*, when the resistance values of the gain resistors R1 and R2 are $R_1$ and $R_2$, respectively, the voltage $V_{CONN}$ at the connecting part 22 is maintained at the target voltage determined by the reference voltage $V_{REF}$ and the bias voltage $V_{BIAS}$; that is, $(1+R_2/R_1)V_{REF}+(R_2/R_1)V_{BIAS}$.

Stated differently, regardless of the resistance values of the gain resistors R1 and R2, the voltage obtained by multiplying the reference voltage $V_{REF}$ by the gain greater than one is used as the target voltage for the voltage $V_{CONN}$ at the connecting part 22. With this, it is possible to define a desired target voltage using a low-voltage reference voltage $V_{REF}$. Accordingly, it is possible to achieve low-voltage circuit configuration of the reference voltage generating unit 70, allowing a reduction in circuit area and power consumption in the reference voltage generating unit 70.

Figure 6:
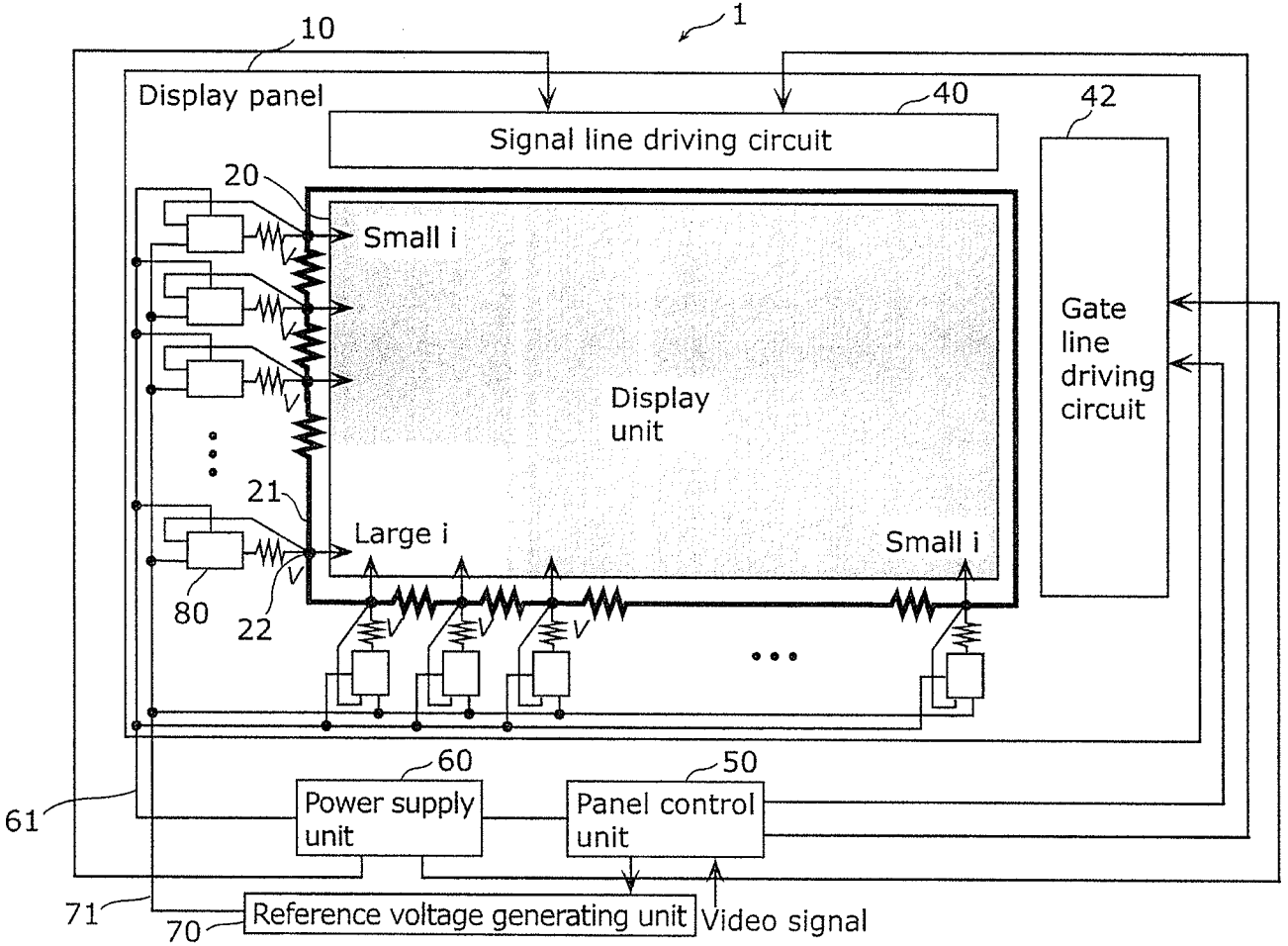
FIG. 6 illustrates an example of display by the organic EL display device according to the embodiment.

FIG. 6 illustrates an example of a display result in the organic EL display apparatus 1 obtained when displaying the image used in the description for FIG. 19.

As illustrated in FIG. 6, in the organic EL display apparatus 1, the voltage in each of the connecting parts in the bus line 21 is evened out to the target voltage V according to the reference voltage. Accordingly, the degradation in the display quality that can be found in the conventional organic EL display device 9, that is, inconvenience of uneven luminance in a region in which the display should be in even luminance.

As described above, according to the organic EL display apparatus 1, the feedback circuit unit 80 maintains the voltage at the connecting part 22 in the bus line 21 to the target voltage determined by the reference voltage $V_{REF}$. Accordingly, the voltage the connecting parts 22 in the bus line 21 is evened out without requiring a reduction in the resistance in the bus line 21, regardless of a display pattern. Consequently, even if the image including a high luminance region is displayed, the luminance in a region near the high luminance region does not decrease, and the quality of the display is improved. Furthermore, since it is not necessary to reduce the resistance in the bus line 21, it is not necessary to provide a large area of bus line. This is suitable for reducing an area for a frame.

Note that, an individual reference voltage may be applied to each feedback circuit unit 80. Alternatively, the target voltage V at each connecting part 22 in the bus line 21 may be different, according to the display pattern.

Figure 7:
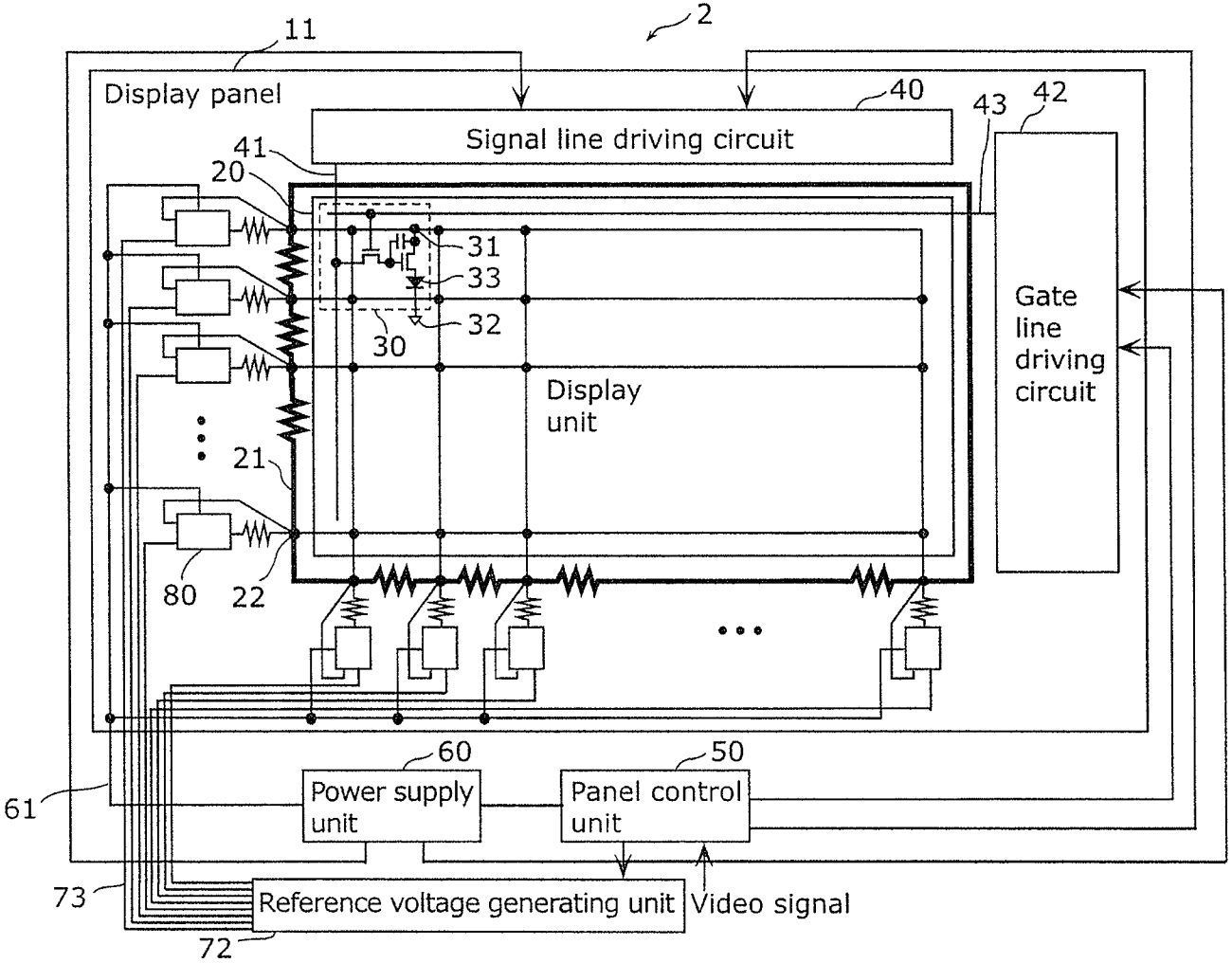
FIG. 7 is a block diagram illustrating an example of a functional configuration of an organic EL display apparatus according to the embodiment.

FIG. 7 is a block diagram illustrating an example of a functional configuration of an organic EL display apparatus 2 according to the variation.

As illustrated in FIG. 7, in the organic EL display apparatus 2, reference voltage lines 73 composed of lines provided for each of the feedback circuit unit 80 are provided in the display panel 11. The reference voltage generating unit 72 generates a reference voltage individual to each of the feedback circuit units 80, and applies the generated reference voltage to the feedback circuit unit 80 through a corresponding line in the reference voltage lines 73.

In this configuration, for example, a reference voltage higher than the reference voltage for other feedback circuit units 80 may be applied to a feedback circuit unit 80 provided near the high luminance region. With this, the voltage drop generated in the first power supply line 31 extending from the connecting part 22 toward the inside of the display unit 20 is corrected. Accordingly, further improvement on the display quality is expected.

Next, a more actual configuration of the connecting part 22 shall be described.

In the description described above, the output terminal 85 and the second input terminal 86 in the feedback circuit unit 80 are connected to the connecting part 22 which is a part of the bus line 21, for simplicity of description. However, the output terminal 85 is actually connected to a region with a certain size in the connecting part 22 in the bus line 21 via the power supply line 81, and the second input terminal 86 is connected to the region through the monitoring line 82.

Figure 8A:
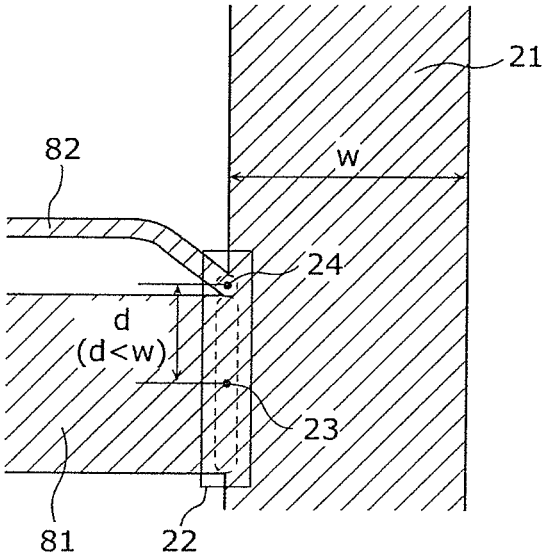
FIG. 8A is a plan view illustrating an example of the shape of lines according to the embodiment.
Figure 8B:
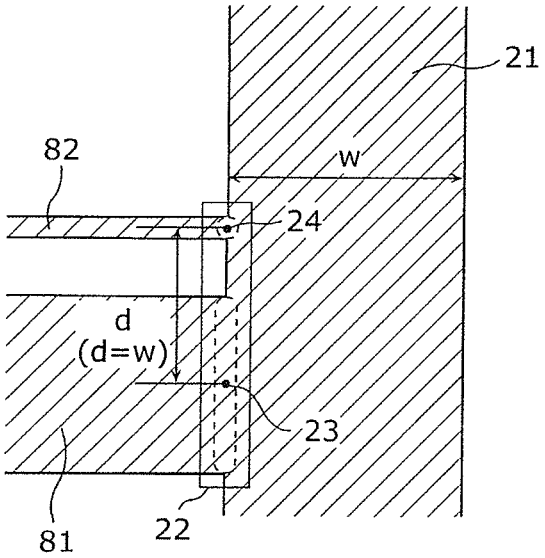
FIG. 8B is a plan view illustrating an example of the shape of lines according to the embodiment.

FIG. 8A and FIG. 8B are plan views illustrating an example of the shape of lines in the bus line 21, the power supply line 81, the monitoring line 82 near the connecting part 22, illustrating a state in which the power supply line 81 and the monitoring line 82 are connected to the bus line 21 from the left side of the drawing.

A region in which the bus line 21 is connected with the power supply line 81 and the monitoring line 82 is illustrated as a circle of dotted line. In this specification, a central point in a region at which the bus line 21 and the power supply line 81 are connected is defined as a power supply point 23, and a central point in a region at which the bus line 21 and the monitoring line 82 are connected is defined as a monitoring point 24.

Figure 9:
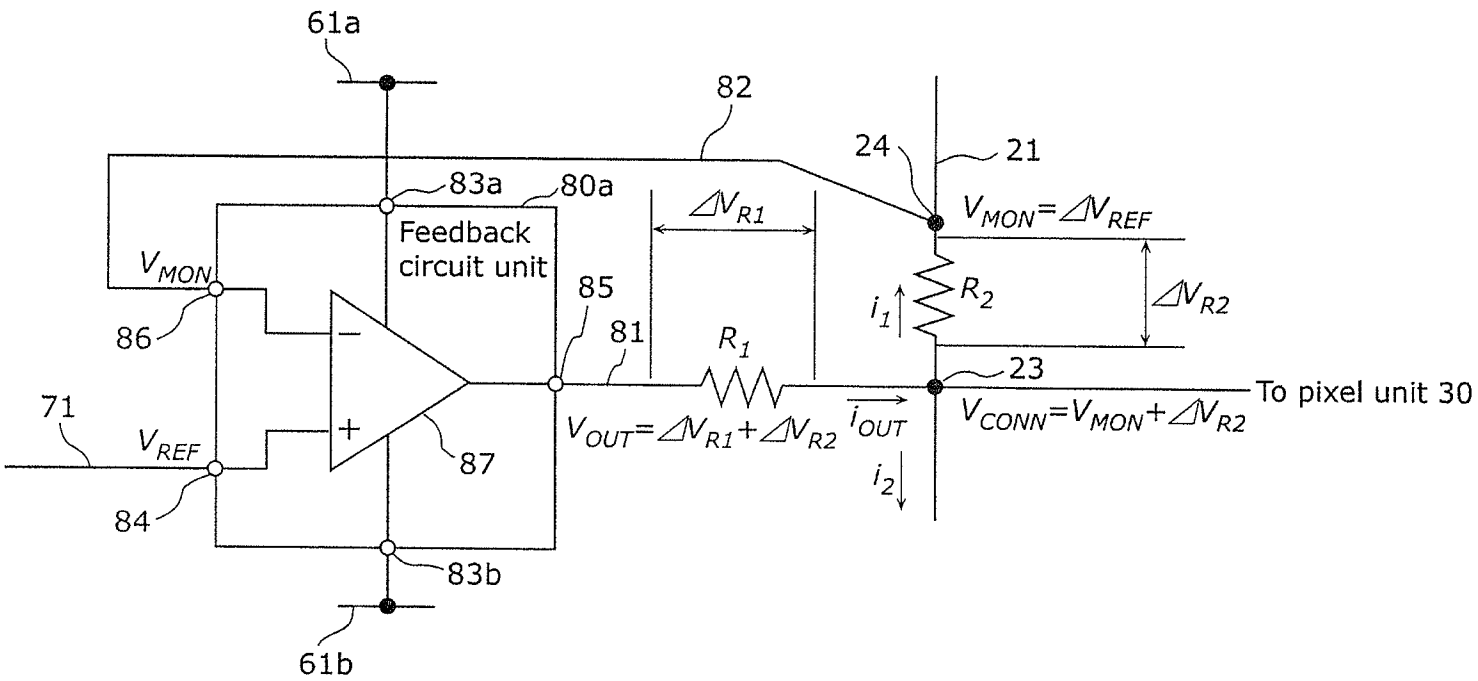
FIG. 9 is an equivalent circuit diagram illustrating an actual example of major components of the organic EL display apparatus according to the embodiment.

FIG. 9 is an equivalent circuit diagram corresponding to this actual configuration.

The equivalent circuit diagram in FIG. 9 is different from the circuit diagram in FIG. 3 in that the power supply point 23 and the monitoring point 24 are provided in different positions in the bus line 21, and are connected by resistance in the bus line 21.

If the resistance value of the power supply line 81 is $R_1$, the voltage drop in the power supply line 81 is $\Delta V_{R1}$, a resistance value in the bus line 21 between the power supply point 23 and the monitoring point 24 is $R_2$, and the voltage drop between the connecting part 22 and the monitoring point 24 is $\Delta V_{R2}$, the voltage $V_{CONN}$ at the power supply point 23 is maintained at a voltage higher than the voltage at the monitoring point 24 $V_{MON}$ by $\Delta V_{R2}$.

Here, the voltage at the monitoring point 24 $V_{MON}$ is maintained at the target voltage. The driving voltage supplied to the pixel unit 30 is a voltage $V_{CONN}$ at the power supply point 23. Accordingly, $\Delta V_{R2}$ is an error from the target voltage of the driving voltage.

In order to reduce this error, in the organic EL display apparatus 1 disclosed herein, a distance d between the power supply point 23 and the monitoring point 24 is determined to be smaller than or equal to a width w of the bus line 21, as illustrated in FIG. 8A and FIG. 8B, as an example. More specifically, FIG. 8A illustrates an example of a shape in which the power supply point 23 and the monitoring point 24 are provided closest to each other, and FIG. 8B illustrates an example of a shape in which the power supply point 23 and the monitoring point 24 are provided farthest apart from each other.

Specific examples using the error amplifier in the feedback circuit unit 80 and actual configuration examples of the connecting part are described above. The following is description of other specific examples of the feedback circuit unit 80.

Figure 10:
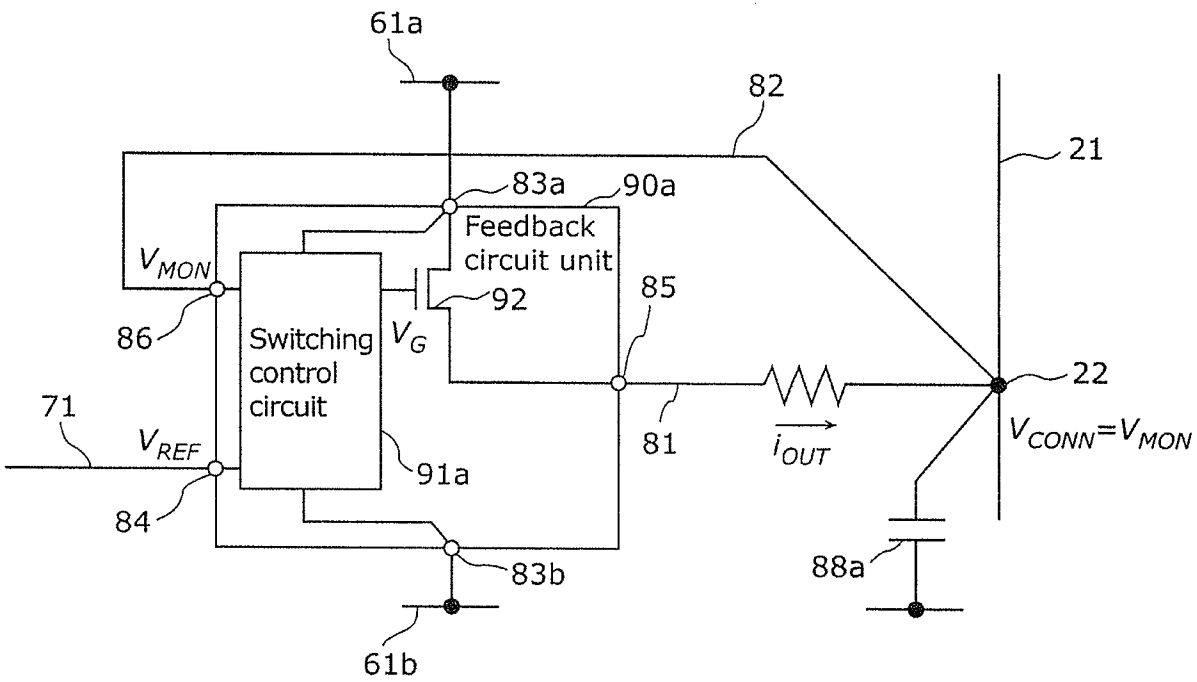
FIG. 10 is a block diagram illustrating an example of the feedback circuit unit according to the embodiment.

FIG. 10 is a circuit diagram of a feedback circuit unit 90*a* which is another specific example of the feedback circuit unit 80. Note that the illustration of the connecting part 22 is simplified again.

The feedback circuit unit 90*a* is an example of principal feedback circuit unit which performs switching operation, and is configured of a switching control circuit 91*a* and a transistor 92. The switching control circuit 91*a* performs comparison operation using the voltage $V_{CONN}$ (=$V_{MON}$) in the connecting part 22 and the reference voltage $V_{REF}$ by a comparator incorporated (not illustrated). Subsequently, when it is determined that the voltage $V_{CONN}$ in the connecting part 22 is smaller than the target voltage determined by the reference voltage $V_{REF}$, a gate signal $V_G$ at a level $V_{on}$ for turning the transistor 92 on is provided, and when it is determined that the voltage $V_{CONN}$ is greater than the target voltage, a gate signal $V_G$ at a level $V_{off}$ for turning the transistor 92 off is provided.

The transistor 92 has one source/drain terminal connected to the first power supply terminal 83*a*, and the other source/drain terminal connected to the output terminal 85, and supplies or blocks the power supply voltage to be applied to the first power supply terminal 83*a* to the output terminal 85, according to the gate signal $V_G$ applied from the switching control circuit 91*a*. The voltage $V_{CONN}$ at the connecting part 22 is smoothed by a capacitor 88*a* which is capacitance in the first power supply line 31 (FIG. 1) extended from the bus line 21 and the connecting part 22 toward the inside of the display unit 20. Note that, the capacitor 88*a* may be parasitic capacitance of the panel. Furthermore, as the capacitor 88*a*, a capacitor having a first electrode connected to the bus line 21 and a second electrode connected to the fixed potential may be provided.

Figure 20:
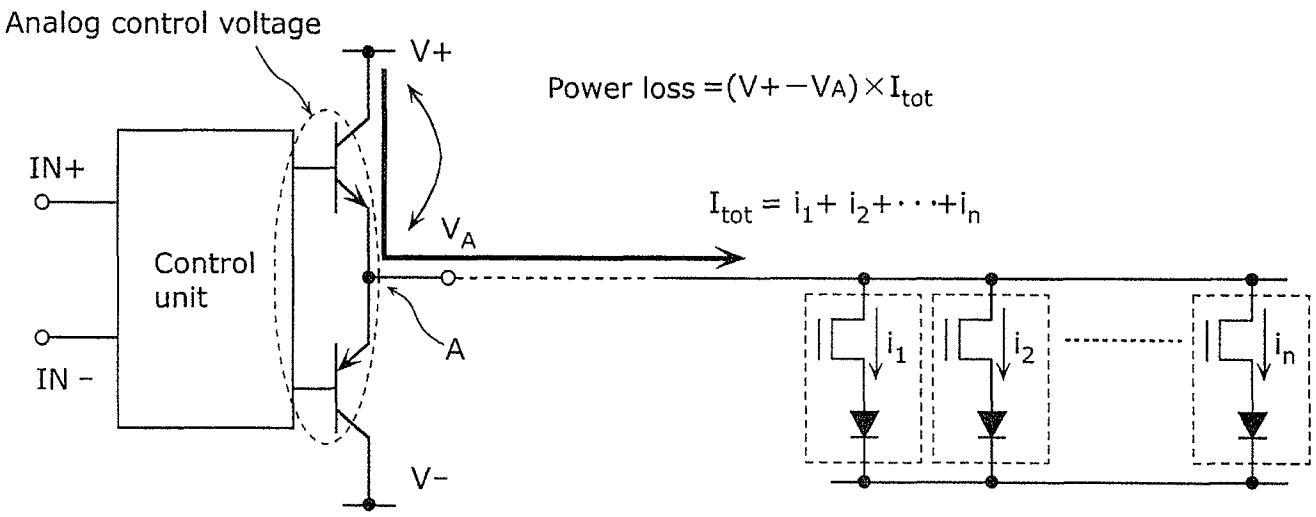
FIG. 20 illustrates a power loss in a comparative example in which a voltage to be supplied to an output terminal is controlled by an operational amplifier.

Here, a comparative example in which the voltage to be supplied to the output terminal is controlled by an operational amplifier shall be described with reference to FIG. 20. In this comparative example, a switch on the positive power supply side is controlled by an analog control voltage. This generates a voltage drop since a switch controlled by the analog voltage is provided between the positive power supply side and the point A. If the potential at the positive power supply is V+, and the potential at the point A is $V_A$, the voltage drop is $(V+-V_A)$. Accordingly, $(V+-V_A)\times Itot$, which is a product of the voltage drop and the flowing current Itot is a power loss.

In contrast, in the embodiment, the feedback circuit unit 90*a* includes the switching control circuit 91*a* and the transistor 92, and the switching control circuit 91*a* controls on and off of the transistor 92. Furthermore, in the inside of the feedback circuit unit 90*a*, by using the transistor 92 having one terminal connected to the power supply terminal 83*a* and the other terminal connected to the output terminal 85, when the voltage at the connecting part 22 in the bus line 21 is lower than the target voltage, it is not necessary to supply voltage from the power supply voltage to the output terminal 85. Accordingly, the transistor 92 is turned off in this case. When the voltage at the connecting part 22 in the bus line 21 is higher than the target voltage, the voltage is supplied from the power supply voltage to the output terminal 85. Accordingly, the transistor 92 is turned on to be low resistance (ideally, 0Ω). With this, the power loss in the comparative example using the operational amplifier is reduced. Accordingly, the target voltage can be effectively supplied from the power supply voltage to the output terminal.

Figure 11:
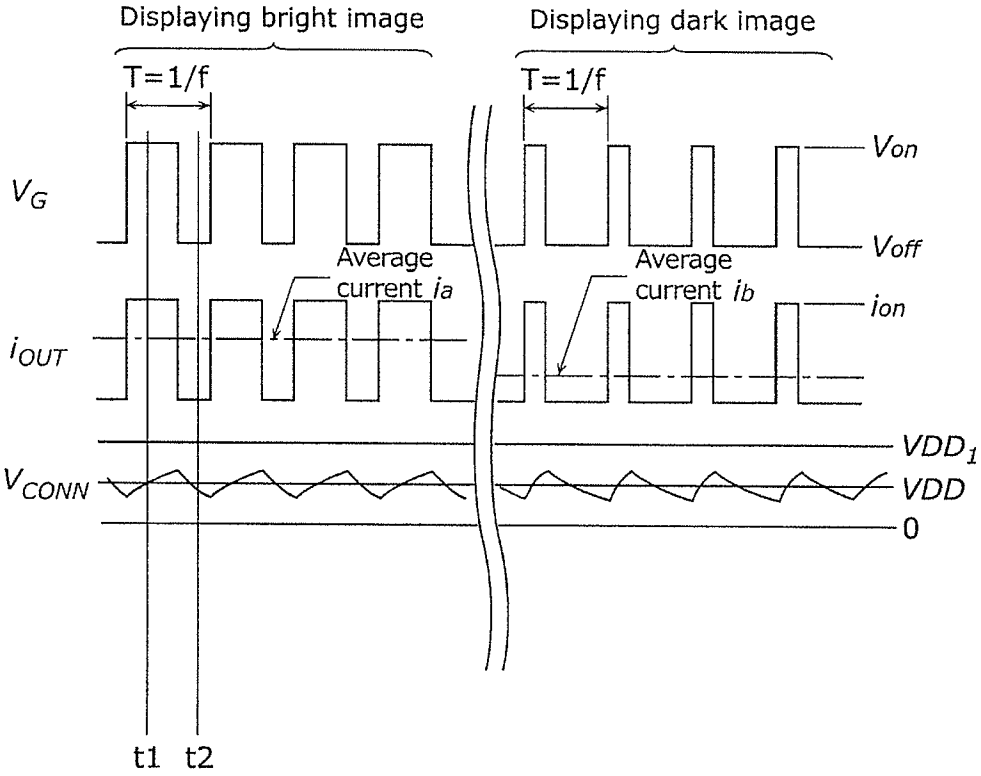
FIG. 11 is a timing chart illustrating an example of the operation of the feedback circuit unit according to the embodiment.

FIG. 11 is a timing chart illustrating an example of the operation by the feedback circuit unit 90*a*. In this timing chart, the power supply voltage applied on the first power supply terminal 83*a* is denoted as $VDD_1$, and the target voltage defined by the reference voltage $V_{REF}$ is denoted as VDD. In FIG. 11, two types of waveforms each corresponding to a different value of pixel current. More specifically, the waveform on the left of FIG. 11 represents a case in which a large pixel current flows, since a bright image is displayed. The waveform on the right of FIG. 11 represents a case in which a small pixel current flows, since a dark image is displayed.

When the gate signal $V_G$ reaches a $V_{on}$ level, turning on the transistor 92, a power supply voltage $VDD_1$ applied on the first power supply terminal 83*a* is supplied from the output terminal 85 to the connecting part 22, and output current $i_{OUT}$ having a current value of $i_{on}$ flows. The voltage $V_{CONN}$ in the connecting part 22 increases toward $VDD_1$ in a time constant determined by the capacitance in the bus line 21 and the first power supply line 31 in the display unit 20 and $i_{on}$.

In the time t1, when the voltage $V_{CONN}$ in the connecting part 22 is higher than the target voltage VDD, the gate signal $V_G$ falls in a $V_{off}$ level after a delay time unique to the switching control circuit 91*a*, turning off the transistor 92. The unique delay time is a time difference between a time when the voltage $V_{CONN}$ in the connecting part 22 exceeds the target voltage VDD, and a time afterwards when the switching control circuit compares the voltage $V_{CONN}$ and the target voltage VDD and starts an operation for turning off the transistor 92.

As a result, the supply of the power supply voltage from the output terminal 85 to the connecting part 22 is cut off, stopping the output current $i_{OUT}$. The voltage $V_{CONN}$ at the connecting part 22 drops toward 0 V, which is the ground voltage, in a time constant determined by the capacitance in the bus line 21 and the first power supply line 31 in the display unit 20 and the resistance component of the pixel circuit group composing the display unit (the resistance component is the reciprocal of the rate of change of the panel current value when the voltage $V_{CONN}$ changes per unit voltage; that is, when a bright image is displayed, in a time constant smaller than the time constant when a dark image is displayed, and when a dark image is displayed, in a time constant greater than the time constant when a bright image is displayed).

As described above, the turn-on current $i_{on}$ flows intermittently. As a result, a large average current $i_a$ flows when a bright image is displayed, and a small average current $i_b$ flows when a dark image is displayed as an average value of the output current $i_{OUT}$.

At time t2, when the voltage $V_{CONN}$ at the connecting part 22 is lower than the target voltage VDD, after the unique delay time of the switching control circuit 91*a*, the gate signal $V_G$ is on the $V_{on}$ level, turning on the transistor 92.

By repeating the operations, the voltage $V_{CONN}$ at the connecting part 22 is maintained in a predetermined voltage range including the target voltage VDD.

Figure 12:
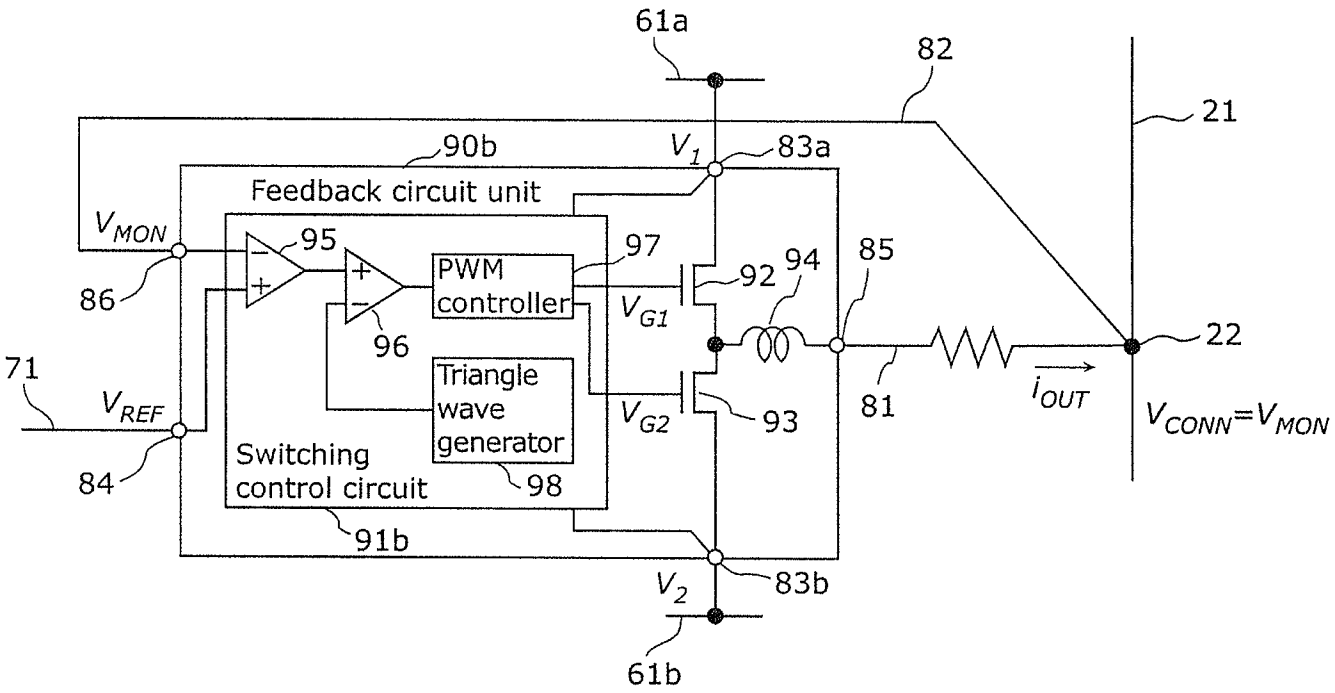
FIG. 12 is a block diagram illustrating an example of the feedback circuit unit according to the embodiment.

FIG. 12 is a circuit diagram of a feedback circuit unit 90*b* which is another specific example of the feedback circuit unit 80.

The feedback circuit unit 90*b* is an example of a more practical feedback circuit unit which performs the pulsewidth modulation (PWM) switching operation, including a switching control circuit 91*b*, transistors 92 and 93, and a coil 94. The switching control circuit 91*b* includes an error amplifier 95, a PWM comparator 96, a PWM controller 97, and a triangle wave generator 98.

Figure 13:
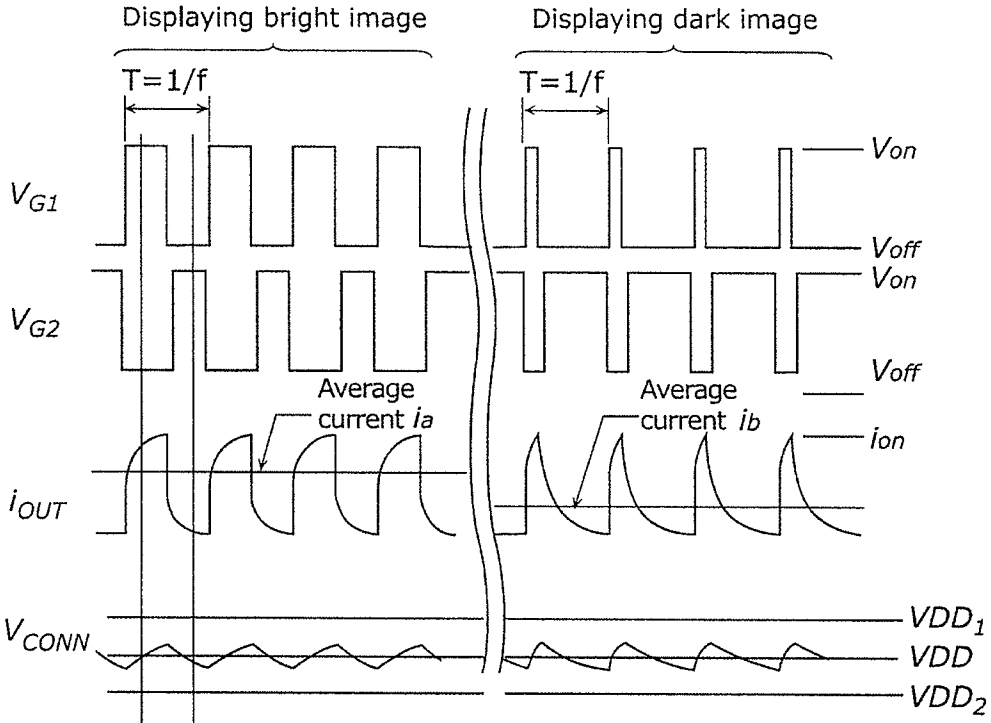
FIG. 13 is a timing chart illustrating an example of the operation of the feedback circuit unit according to the embodiment.

FIG. 13 is a timing chart illustrating an example of the operation by the feedback circuit unit 90*b*. In the timing chart, the power supply voltage applied to the first power supply terminal 83*a* is denoted as $VDD_1$, the power supply voltage applied to the second power supply terminal 83*b* is denoted as $VDD_2$, the target voltage determined by the reference voltage $V_{REF}$ is denoted as VDD. In FIG. 13, two types of waveforms each corresponding to a different pixel current according to the brightness of the displayed image are illustrated.

First, the transistor 92 is turned on, and the transistor 93 is turned off, according to the gate signals $V_{G1}$ and $V_{G2}$ applied by the switching control circuit 91*b*, respectively, and the coil 94 is connected to the first power supply terminal 83*a*.

The voltage $V_{CONN}$ in the connecting part 22 shifts closer to the power supply voltage $VDD_1$ applied to the first power supply terminal 83*a*. The error amplifier 95 compares the voltage $V_{MON}$ (=$V_{CONN}$) applied to the second input terminal 86 and the voltage $V_{REF}$ applied to the first input terminal 84.

In the time t1, when the voltage $V_{CONN}$ at the connecting part 22 is greater than the target voltage VDD, and the comparison result of the error amplifier 95 is inverted, the PWM controller 97 inverts the level of the gate signals $V_{G1}$ and $V_{G2}$ sequentially in a time difference. With this, the transistor 92 is turned off and then the transistor 93 is turned on. With this, the connection in the coil 94 is switched from the first power supply terminal 83*a* to the second power supply terminal 83*b*.

Here, the output current $i_{OUT}$ flowing from the first power supply terminal 83*a* to the output terminal 85 through the transistor 92 and the coil 94 keeps flowing from the second power supply terminal 83*b* to the output terminal 85 via the transistor 93 and the coil 94 by a self induction of the coil 94, even after the connection of the coil 94 is switched.

The energy of the self induction stored in the coil 94 decreases with time, and an output current $i_{OUT}$ decreases, making the voltage in the output terminal 85 smaller, and the voltage $V_{CONN}$ in the connecting part 22 shifts closer to $VDD_2$ which is the voltage at the second power supply terminal 83*b*.

In the time t2, when the voltage $V_{CONN}$ at the connecting part 22 is smaller than the target voltage VDD, and the comparison result of the error amplifier 95 is inverted, the PWM controller 97 inverts the level of the gate signals $V_{G2}$ and $V_{G1}$ sequentially in a time difference. With this, after the transistor 93 is turned off, the transistor 92 is turned on. With this operation, the connection of the coil 94 is switched from the second power supply terminal 83*b* to the first power supply terminal 83*a*.

By repeating the operations, the voltage $V_{CONN}$ at the connecting part 22 is maintained in a predetermined voltage range including the target voltage VDD.

By configuring the feedback circuit unit using the switching control circuit, the power consumption in the feedback circuit unit is reduced. Thus, the power efficiency in the organic EL display apparatus is improved, and an effect of simplifying the response to heat can be expected.

In the description above, the configuration in which the bus line 21 is used as a positive power supply for the pixel units 30 have been described. For example, in the organic EL display apparatus 1 in FIG. 1, the driving voltage of the bus line 21 controlled to the target voltage by the feedback circuit unit 80 is used as the power supply voltage on the high-potential side for the pixel units 30. With this, the pixel current is supplied from the bus line 21 to the pixel units 30.

In contrast, another configuration using the bus line 21 as the negative power supply is possible. The following is the description of the configuration.

Figure 14:
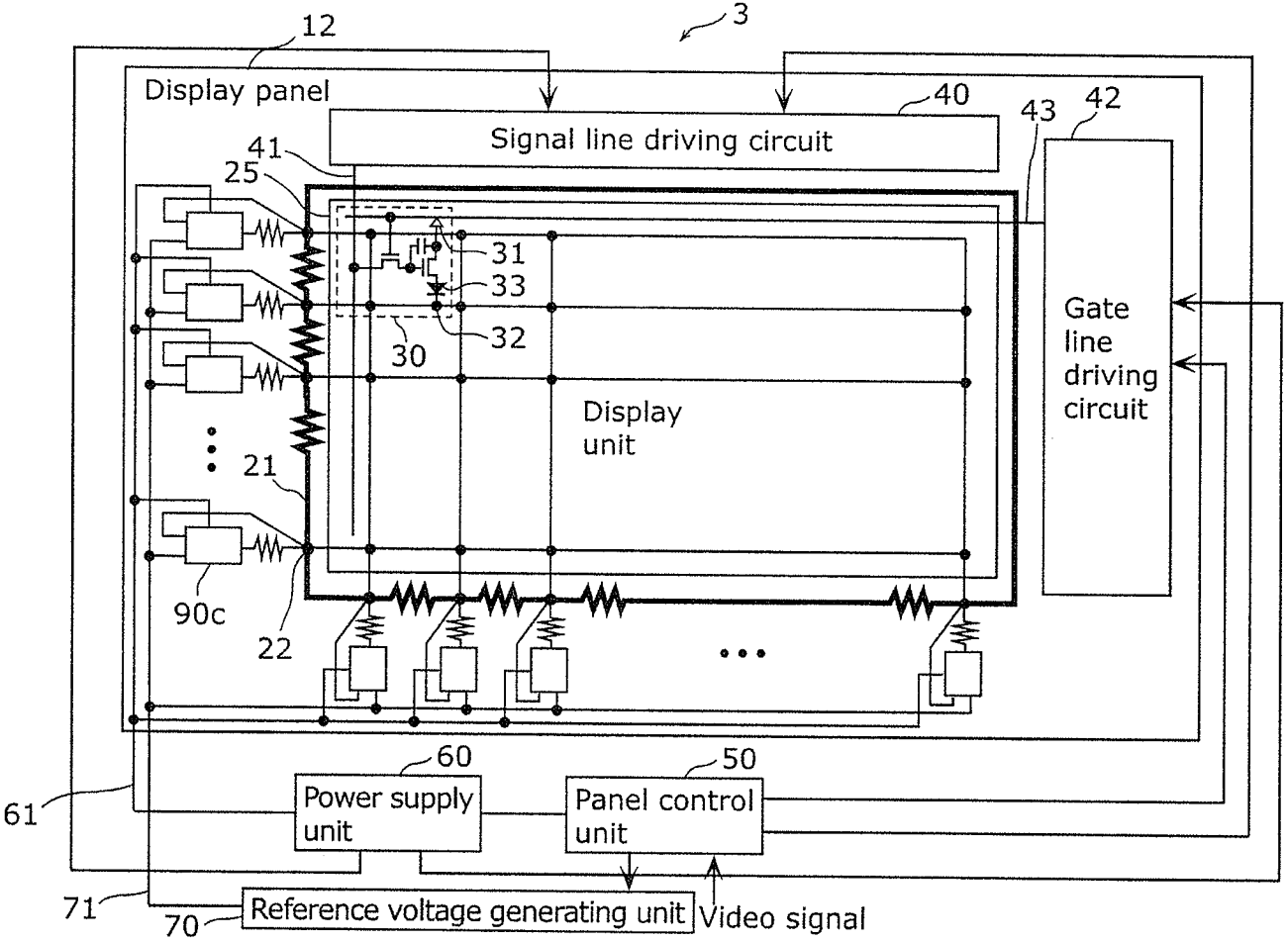
FIG. 14 is a block diagram illustrating an example of a functional configuration of the organic EL display apparatus according to the embodiment.

FIG. 14 is a block diagram illustrating an example of a functional configuration of the organic EL display apparatus 3 in which the bus line 21 is used as the negative power supply.

In the organic EL display apparatus 3, the display panel 12 is used instead of the display panel 10 in the organic EL display apparatus 1 in FIG. 1. The display panel 12 includes a feedback circuit unit 90*c* which is capable of supplying a negative power supply, and the second power supply lines 32 are extended in the display unit 25, diverging from the connecting parts 22 in the bus line 21. Furthermore, although detailed illustration is omitted, the first power supply lines 31 are provided in the display unit 25.

A first electrode (anode) of the organic EL element 33 is electrically connected to the first power supply line 31 via the driving transistor, and a second electrode (cathode) of the organic EL element 33 is electrically connected to the second power supply line 32.

Figure 15:
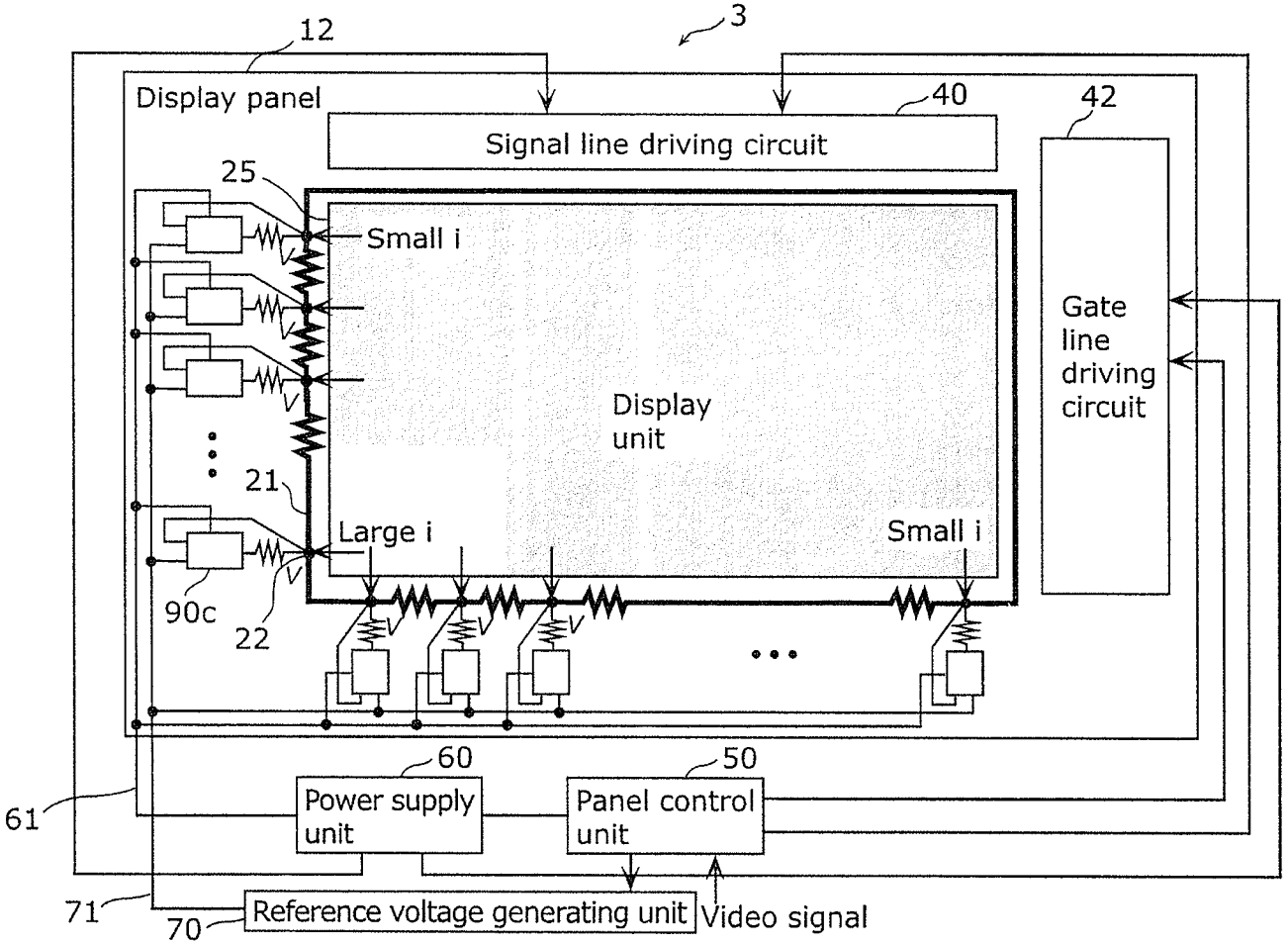
FIG. 15 illustrates an example of display by the organic EL display apparatus according to the embodiment.

As illustrated in FIG. 15, in the organic EL display apparatus 3, the driving voltage of the bus line 21 controlled to the target voltage by the feedback circuit unit 90*c* is used as the low-potential side power supply voltage for the pixel unit 30. With this, the pixel current is extracted from the pixel unit 30 to the bus line 21.

Figure 16:
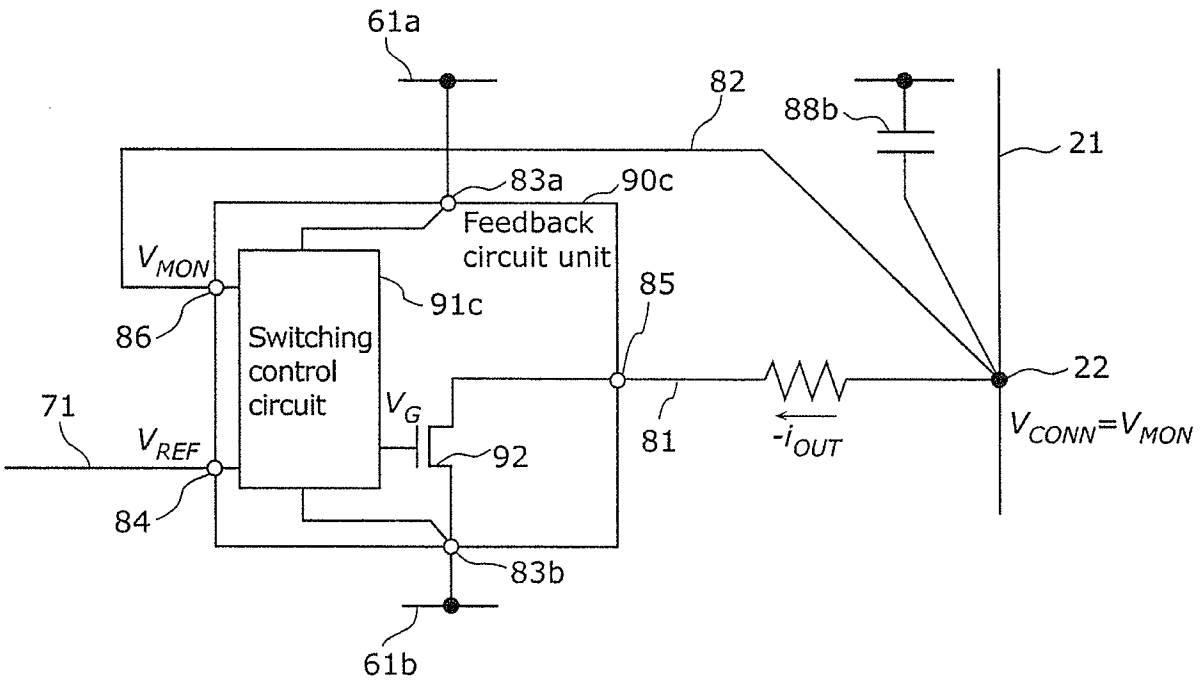
FIG. 16 is a block diagram illustrating an example of the feedback circuit unit according to the embodiment.

FIG. 16 is a circuit diagram illustrating an example of the feedback circuit unit 90*c*.

The feedback circuit unit 90*c* is different from the feedback circuit unit 90*a* in FIG. 10 in that the function of the switching control circuit 91*c* and the connection of the transistor 92 are different.

The switching control circuit 91*c* performs comparison operation using the voltage $V_{CONN}$ (=$V_{MON}$) in the connecting part 22 and the reference voltage $V_{REF}$ by a comparator incorporated (not illustrated). Subsequently, when it is determined that the voltage $V_{CONN}$ in the connecting part 22 is smaller than the target voltage determined by the reference voltage $V_{REF}$, a gate signal $V_G$ at a level $V_{on}$ for turning the transistor 92 on is provided, and when it is determined that the voltage $V_{CONN}$ is smaller than the target voltage, a gate signal $V_G$ at a level $V_{off}$ for turning the transistor 92 off is provided.

The transistor 92 has one source/drain terminal connected to the second power supply terminal 83*b*, and the other source/drain terminal connected to the output terminal 85, and supplies or blocks the power supply voltage to be applied to the second power supply terminal 83*b* to the output terminal 85, according to the gate signal $V_G$ applied from the switching control circuit 91*c*. The voltage $V_{CONN}$ at the connecting part 22 is smoothed by a capacitor 88*b* which is capacitance in the second power supply line 32 (FIG. 14) extended from the bus line 21 and the connecting part 22 toward the inside of the display unit 25.

Figure 17:
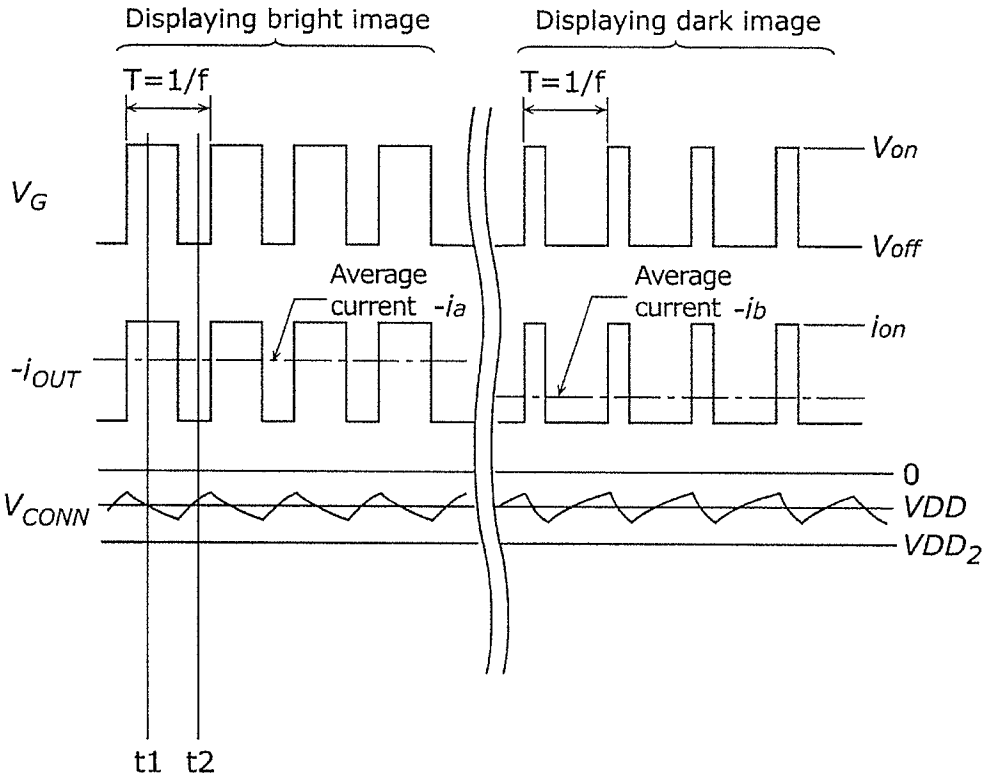
FIG. 17 is a timing chart illustrating an example of the operation of the feedback circuit unit according to the embodiment.

FIG. 17 is a timing chart illustrating an example of the operation by the feedback circuit unit 90*c*. In this timing chart, the power supply voltage applied on the first power supply terminal 83*b* is denoted as $VDD_2$, and the target voltage defined by the reference voltage $V_{REF}$ is denoted as VDD. In consideration of the pull-out direction of the output current from the feedback circuit unit 90*c*, the current is denoted as $-i_{out}$. In FIG. 17, two types of waveforms each corresponding to a different pixel current according to the brightness of the displayed image are illustrated.

As illustrated in FIG. 17, the feedback circuit unit 90*c* operates symmetrical to the feedback circuit unit 90*a*. With this operation, the voltage $V_{CONN}$ at the connecting part 22 in the bus line 21 is maintained in a predetermined voltage range including the target voltage VDD.

The description above is directed to the organic EL display apparatuses 1 to 3 which evens out the voltage in the bus line by the feedback circuit unit, with reference to specific examples of the organic EL display apparatuses in which the feedback circuit unit is composed with the error amplifier, and the feedback circuit unit is composed using the switching control circuit (for example, a DC voltage converter or a DC-DC converter). The organic EL display apparatuses 1 to 3 can be used for displaying high-quality image in devices such as a television set, a personal computer, and a mobile information terminal.

Figure 18:
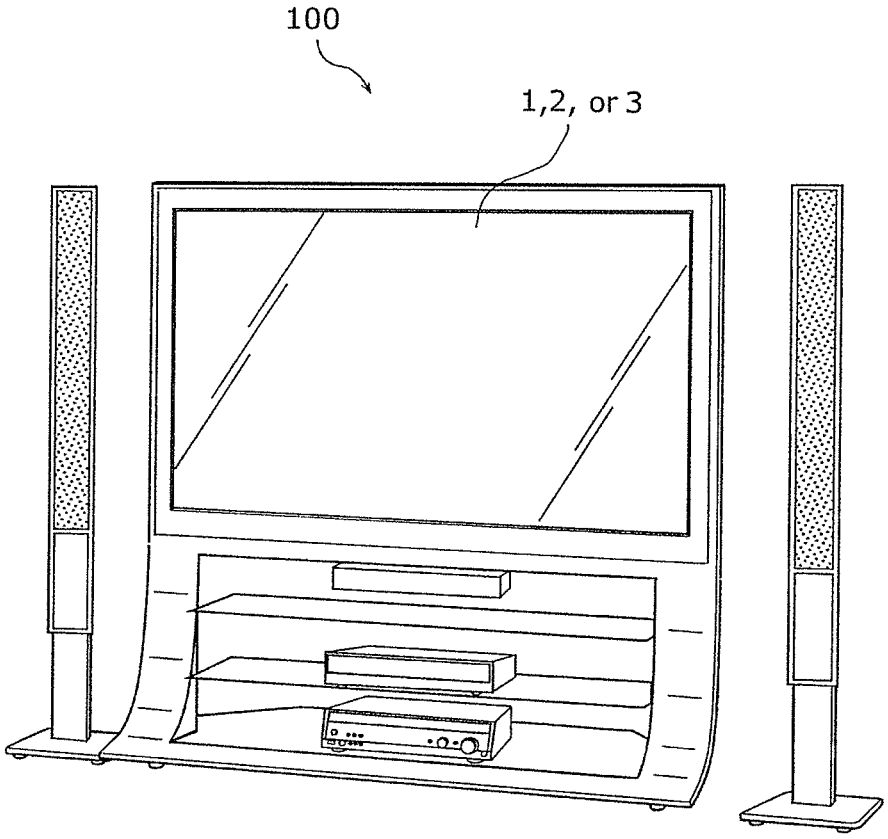
FIG. 18 is an external view illustrating an example a television set using the organic EL display apparatus according to the embodiment.

FIG. 18 is an external view of a television set 100 in which the organic EL display apparatus 1, 2, or 3 is used. In the television set 100, by using the organic EL display apparatus 1, 2, or 3, an image including partial high luminance region may be displayed in high quality, while suppressing the unevenness in the luminance in a region other than the high luminance region.

INDUSTRIAL APPLICABILITY

The present disclosure is applicable to an image display apparatus such as the organic EL display apparatus.

The invention claimed is:

1. An organic electroluminescence (EL) display apparatus, comprising:

a display in which a plurality of pixels each including an organic EL element is provided on a substrate;

a power supply bus line which is provided in an outer periphery of the display and supplies, to each of the pixels in the display, a driving voltage for driving the pixel;

a feedback circuit configured to generate an output voltage and supply the output voltage to the power supply bus line;

a power supply configured to supply, to the feedback circuit, a power supply voltage including a high power supply voltage for driving the feedback circuit and a low power supply voltage which is lower than the high power supply voltage; and a reference voltage generator unit configured to supply, to the feedback circuit, a reference voltage for determining a target voltage to be a voltage in the power supply bus line, the target voltage being determined by amplifying the reference voltage, wherein the feedback circuit is configured to generate the output voltage based on the power supply voltage supplied from the power supply, the feedback circuit includes:

a first power supply terminal to which the high power supply voltage of the power supply voltage is applied;

a second power supply terminal to which the low power supply voltage of the power supply voltage is applied;

a first input terminal to which the reference voltage is applied;

an output terminal connected to a connecting part which is a part of the power supply bus line;

a second input terminal to which a voltage at the connecting part in the power supply bus line is applied;

a switching control circuit connected to the first power supply terminal, the second power supply terminal, the first input terminal, and the second input terminal; and a transistor having one terminal connected to one of the first power supply terminal and the second power supply terminal, and the other terminal connected to the output terminal, a voltage obtained by adding a difference to the voltage at the connecting part in the power supply bus line is provided to the output terminal by supplying or blocking the power supply voltage to be applied to the one of the first and second power supply terminals as the power supply voltage by turning the transistor on or off, so that the voltage at the connecting part in the power supply bus line is equal to the target voltage defined by amplifying the reference voltage, and the difference added corresponds to a voltage drop calculated as a product of (i) a resistance between the output terminal of the feedback circuit and the connecting part in the power supply bus line and (ii) a current flowing between the output terminal of the feedback circuit and the connecting part in the power supply bus line.

2. The organic EL display apparatus according to claim 1, further comprising a capacitor including a first electrode and a second electrode, the first electrode being connected to the power supply bus line, and the second electrode being connected to a fixed potential.

3. The organic EL display apparatus according to claim 1, wherein the switching control circuit compares the voltage at the connecting part and the reference voltage, by using a comparator, outputs, when it is determined that the voltage at the connecting part is smaller than the target voltage defined by the reference voltage, a gate signal in a level Von for turning the transistor on, and outputs, when it is determined that the voltage at the connecting part is greater than the target voltage, a gate signal in a level Voff for turning the transistor off.

4. The organic EL display apparatus according to claim 1, wherein, when the feedback circuit determines that the voltage at the connecting part in the power supply bus line is greater than the target voltage, the feedback circuit stops supplying the output voltage so as to reduce the driving voltage.

5. The organic EL display apparatus according to claim 4, wherein, when the feedback circuit determines that the voltage at the connecting part in the power supply bus line is smaller than the target voltage, the feedback circuit resumes the supply of the output voltage so as to increase the driving voltage.

6. The organic EL display apparatus according to claim 1, wherein, when the feedback circuit determines that the voltage at the connecting part in the power supply bus line is smaller than the target voltage, the feedback circuit stops supplying the output voltage so as to increase the driving voltage.

7. The organic EL display apparatus according to claim 6, wherein, when the feedback circuit determines that the voltage at the connecting part in the power supply bus line is greater than the target voltage, the feedback circuit resumes the supply of the output voltage so as to reduce the driving voltage.

8. The organic EL display apparatus according to claim 1, wherein the feedback circuit comprises a plurality of feedback circuits, the feedback circuits are connected to the power supply bus line at a plurality of connecting parts.

9. The organic EL display apparatus according to claim 8, wherein the connecting parts are provided at a constant interval between each other in the power source bus line.

10. The organic EL display apparatus according to claim 8, wherein each of the feedback circuits sets the target voltage to a voltage obtained by multiplying the reference voltage provided to the first input terminal by a gain greater than 1.

11. The organic EL display apparatus according to claim 10, wherein each of the feedback circuits sets the target voltage to the reference voltage provided to the first input terminal, and increases and reduces the voltage at the connecting part in the power supply bus line, such that the voltage at the connecting part is equal to the reference voltage.

12. The organic EL display apparatus according to claim 8, wherein each of the feedback circuits is provided in a periphery on at least one of a right side and a left side of the display.

13. The organic EL display apparatus according to claim 8, wherein each of the feedback circuits is provided in a periphery on at least one side above and below the display.

14. The organic EL display apparatus according to claim 1, further comprising:

a plurality of first power supply lines electrically connected to a first electrode of the organic EL element in each of the pixels; and a plurality of second power supply lines electrically connected to a second electrode of the organic EL element in each of the pixels, wherein one of the first power supply lines and the second power supply lines are connected to the power supply bus line.

15. The organic EL display apparatus according to claim 14, wherein the feedback circuit comprises a plurality of feedback circuits, the feedback circuits are connected to the power supply bus line at a plurality of connecting parts on a shorter side of the power supply bus line, and the one of the first power supply lines and the second power supply lines diverge from the connecting parts of output terminals of the feedback circuits and the power supply bus line, and are provided in a horizontal direction of the display.

16. The organic EL display apparatus according to claim 14, wherein the feedback circuit comprises a plurality of feedback circuits, the feedback circuits are connected to the power supply bus line at a plurality of connecting parts on a longer side of the power supply bus line, and the one of the first power supply lines and the second power supply lines diverge from the connecting parts of output terminals of the feedback circuits and the power supply bus line, and are provided in a vertical direction of the display.

17. The organic EL display apparatus according to claim 14, wherein the feedback circuit comprises a plurality of feedback circuits, the feedback circuits are connected to the power supply bus line at a plurality of connecting parts on a shorter side and a longer side of the power supply bus line, and the one of the first power supply lines and the second power supply lines diverge from the connecting parts of output terminals of the feedback circuits and the power supply bus line, and are provided in a horizontal direction and a vertical direction of the display.

18. The organic EL display apparatus according to claim 1, wherein the power supply bus line is provided as a loop in the outer periphery of the display.

19. The organic EL display apparatus according to claim 1, wherein the connecting part includes:

a power supply point connected to the output terminal of the feedback circuit through a power supply line; and a monitoring point connected to the output terminal of the feedback circuit through a monitoring line, and a distance between the power supply point and the monitoring point is smaller than or equal to a width of the power supply bus line.

* * * * *